US010198989B2

(12) United States Patent
Nakanishi et al.

(10) Patent No.: US 10,198,989 B2
(45) Date of Patent: Feb. 5, 2019

(54) DISPLAY DEVICE, ELECTRONIC APPARATUS, AND METHOD OF DRIVING DISPLAY DEVICE

(71) Applicant: Japan Display Inc., Tokyo (JP)

(72) Inventors: Takayuki Nakanishi, Tokyo (JP); Tatsuya Yata, Tokyo (JP)

(73) Assignee: Japan Display Inc., Tokyo (JP)

( * ) Notice: Subject to any disclaimer, the term of this patent is extended or adjusted under 35 U.S.C. 154(b) by 181 days.

(21) Appl. No.: 15/245,720

(22) Filed: Aug. 24, 2016

(65) Prior Publication Data

US 2017/0061873 A1 Mar. 2, 2017

(30) Foreign Application Priority Data

Aug. 28, 2015 (JP) ..... 2015-169165

(51) Int. Cl.

| | |
|---|---|
| ***G09G 5/00*** | (2006.01) |
| ***G09G 3/3225*** | (2016.01) |
| ***G09G 3/3275*** | (2016.01) |
| ***G09G 3/20*** | (2006.01) |

(52) U.S. Cl.

CPC ..... *G09G 3/3225* (2013.01); *G09G 3/2003* (2013.01); *G09G 3/3275* (2013.01); *G09G 2300/0452* (2013.01); *G09G 2320/0233* (2013.01); *G09G 2330/021* (2013.01)

(58) Field of Classification Search

CPC .. G09G 3/3225; G09G 3/2003; G09G 3/3275; G09G 2320/0233; G09G 2300/0452; G09G 2330/021

See application file for complete search history.

(56) References Cited

U.S. PATENT DOCUMENTS

| | | | | |
|---|---|---|---|---|
| 5,929,928 | A | 7/1999 | Matsugami et al. | |
| 2011/0181635 | A1* | 7/2011 | Kabe ..... | G09G 3/3426 345/694 |
| 2013/0097631 | A1 | 4/2013 | Ikeda | |

FOREIGN PATENT DOCUMENTS

| | | |
|---|---|---|
| JP | 09-284650 | 10/1997 |
| JP | 10-98634 | 4/1998 |
| JP | 2003-051931 | 2/2003 |
| JP | 2003-92676 | 3/2003 |

(Continued)

OTHER PUBLICATIONS

Japanese Office Action dated Nov. 20, 2018 in corresponding Japanese Application No. 2015-169165.

*Primary Examiner* — Jonathan Boyd
(74) *Attorney, Agent, or Firm* — K&L Gates LLP

(57) ABSTRACT

A display device includes an image display panel and a control unit that outputs an output signal to the image display panel and causes an image to be displayed. The control unit includes an input signal acquisition unit that acquires a correction input signal including a control input signal in which a part of data is input signal data including information of an input signal value for causing a pixel to display a predetermined color, and another part of data is a display control code, a processing content determination unit that determine processing content for processing the input signal data to generate an output signal value of the output signal based on the display control code, and an output signal generation unit that generates the output signal based on the processing content determined by the processing content determination unit and the input signal data.

10 Claims, 20 Drawing Sheets

(56) References Cited

FOREIGN PATENT DOCUMENTS

| | | |
|---|---|---|
| JP | 2011-154323 A | 8/2011 |
| JP | 2013-90109 | 5/2013 |

* cited by examiner

DISPLAY DEVICE, ELECTRONIC APPARATUS, AND METHOD OF DRIVING DISPLAY DEVICE

CROSS-REFERENCE TO RELATED APPLICATIONS

This application claims priority from Japanese Application No. 2015-169165, filed on Aug. 28, 2015, the contents of which is incorporated by reference herein in its entirety.

BACKGROUND

1. Technical Field

The present disclosure relates to a display device and an electronic apparatus.

2. Description of the Related Art

In recent years, demands of display devices for mobile electronic apparatuses such as mobile phones and electronic paper have been increasing. In the display devices, one pixel includes a plurality of sub-pixels, and each of the plurality of sub-pixels outputs light of a different color. By switching ON and OFF of display of each of the sub-pixels, various colors are displayed in one pixel. In such display devices, display characteristics such as resolution and luminance have been improved year by year. However, an aperture ratio is decreased as the resolution becomes higher. Therefore, when achieving high luminance, it is necessary to make the luminance of backlight high, and there is a problem of an increase in power consumption of the backlight.

To improve the problem, there is a technology of adding a white pixel that is the fourth sub-pixel to conventional red, green, and blue sub-pixels. This technology can reduce the power consumption and improve display quality by improvement of the luminance by the white pixel.

SUMMARY

According to an aspect, a display device includes an image display panel in which a plurality of pixels is arranged in a matrix manner and a control unit configured to output an output signal to the image display panel to display an image. The control unit includes an input signal acquisition unit configured to acquire a correction input signal including a control input signal in which a part of data is input signal data including information of an input signal value for causing the pixel to display a predetermined color and another part of data is a display control code, a processing content determination unit configured to determine processing content for processing the input signal data to generate an output signal value of the output signal, based on the display control code, and an output signal generation unit configured to generate the output signal, based on the processing content determined by the processing content determination unit and the input signal data.

DETAILED DESCRIPTION

Figure 1:
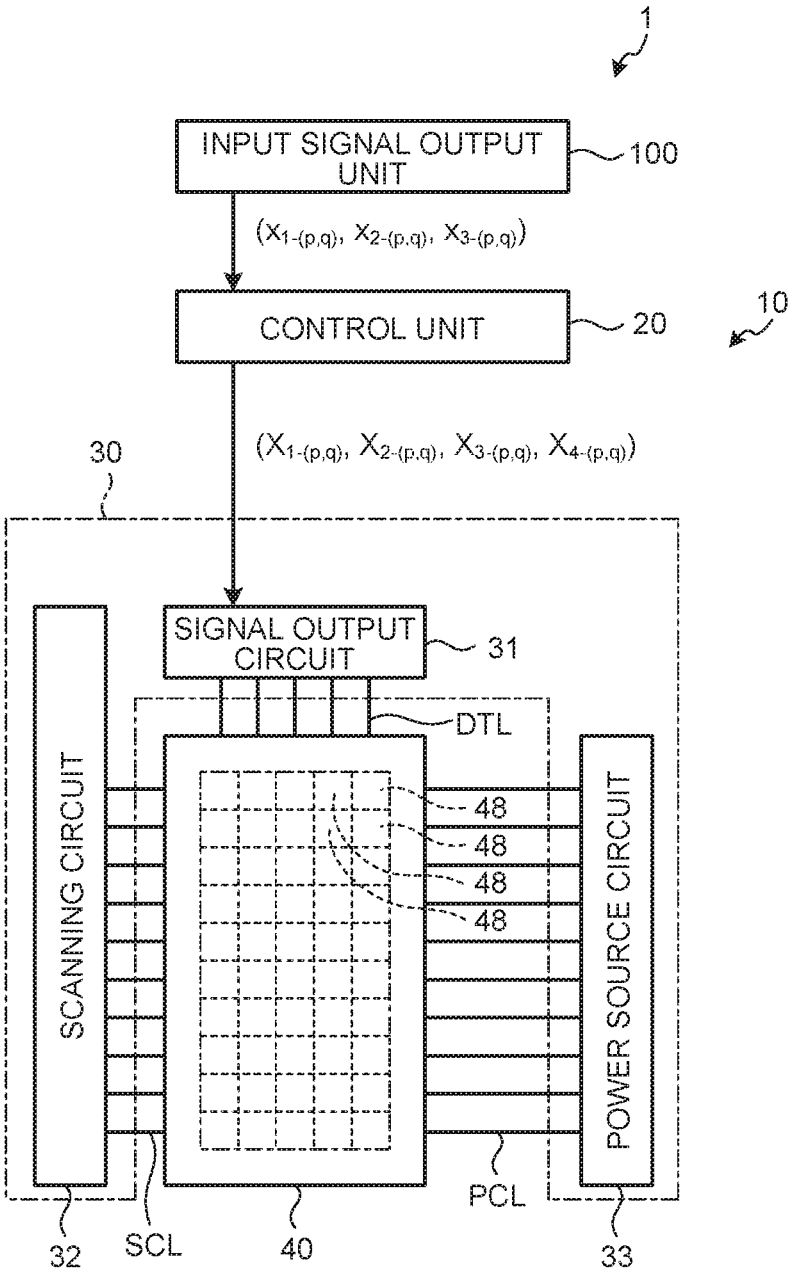
FIG. 1 is a block diagram illustrating an example of a configuration of a display device according to a first embodiment.

Exemplary embodiments of the present invention will be described with reference to the drawings. Noted that the disclosure is merely an example, and appropriate modifications that can be easily conceived by persons skilled in the art while maintaining the concept of the invention should be included in the scope of the present invention. Further, while widths, thicknesses, shapes, and the like of respective portions of the drawings may be schematically illustrated, compared with actual forms, to further clarify the description, the drawings are illustrative only and do not limit the construction of the present invention. Further, in the present specification and the drawings, elements similar to those described with respect to the already illustrated drawings are denoted with the same reference codes, and detailed description may be appropriately omitted.

Meanwhile, there is a case in which the power consumption is increased or the display quality is not improved when image conversion processing is performed such as operation of the white pixel, depending on an image to be displayed. Therefore, in such a case, it is desirable to select whether performing the image conversion processing depending on a type of the image. When causing the display device in an electronic apparatus to display a certain image, there is a case where different images are displayed in one screen, such as a background image and the certain image. In such a case, it is desirable to select whether performing the image conversion processing for each of the different images.

When causing the display device in an electronic apparatus to display an image, typically, an operating system (OS) for operating the electronic apparatus outputs a command for displaying the image and a command of the image conversion processing to a control circuit of the display device, based on a command from an application or the like for displaying an image. The application for displaying the image can determine whether performing the image conversion processing for the image based on data of the image. Meanwhile, timing to output the command for displaying the image and the command of the image conversion processing to the display device depends on the OS and the display device, rather than the application. Therefore, when sending the command to the display device by the OS, it is difficult to synchronize the timing to output the command for displaying the image and the command of the image conversion processing to the display device while determining for which image the image processing is performed. In such a case, appropriate image conversion processing may not be able to be performed for a plurality of images, and reduction of the power consumption or improvement of the display quality may not be able to be appropriately performed.

For the foregoing reasons, there is a need for providing a display device and an electronic apparatus that appropriately reduce power consumption or improve display quality.

First Embodiment

FIG. 1 is a block diagram illustrating an example of a configuration of a display device according to a first embodiment. As illustrated in FIG. 1, a display device 10 of the first embodiment includes a control unit 20, an image display panel drive unit 30, and an image display panel 40. An input signal from an input signal output unit 100 is input to the control unit 20, and the control unit 20 sends a signal generated by applying predetermined data processing to the input signal to respective units of the display device 10. The image display panel drive unit 30 controls driving of the image display panel 40 based on the signal from the control unit 20. The image display panel 40 is a self-emitting image display panel that lights self-emitting bodies of pixels based on a signal from the image display panel drive unit 30 and displays an image. The display device 10 and the input signal output unit 100 configure an electronic apparatus 1 according to the first embodiment.

(Configuration of Image Display Panel)

Figure 2:
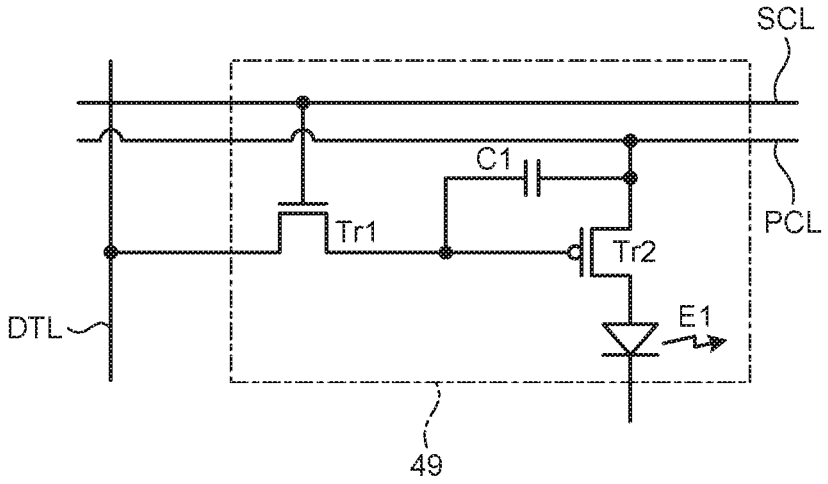
FIG. 2 is a diagram illustrating a lighting drive circuit of a sub-pixel included in a pixel of an image display panel according to the first embodiment.
Figure 3:
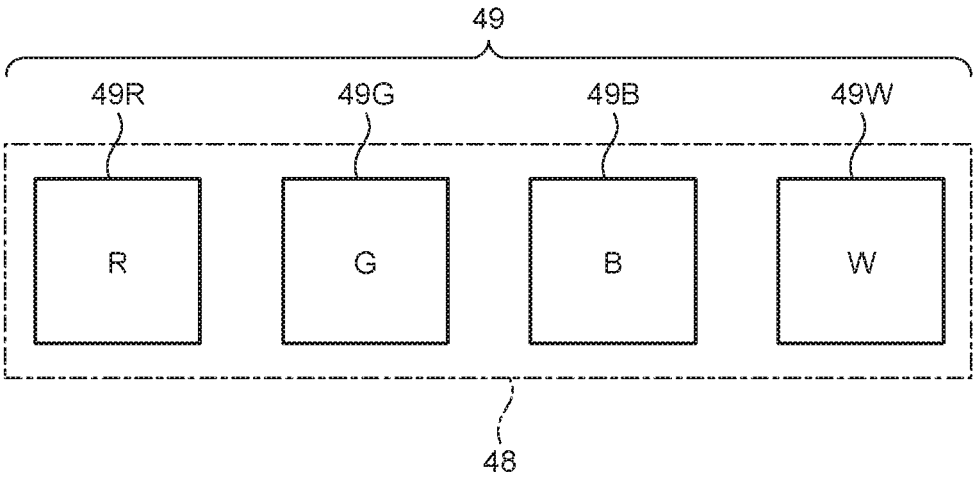
FIG. 3 is a diagram illustrating an array of the sub-pixels of the image display panel according to the first embodiment.
Figure 4:
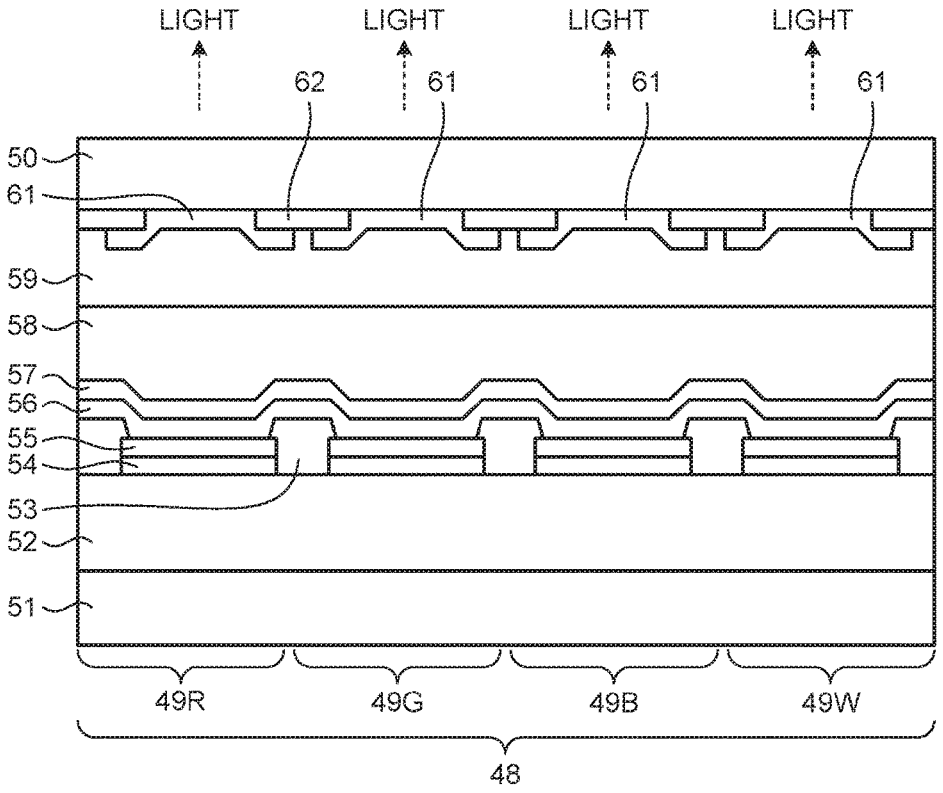
FIG. 4 is a diagram illustrating a sectional structure of the image display panel according to the first embodiment.

First, a configuration of the image display panel 40 will be described. FIG. 2 is a diagram illustrating a lighting drive circuit of a sub-pixel included in the pixel of the image display panel according to the first embodiment. FIG. 3 is a diagram illustrating an array of the sub-pixels of the image display panel according to the first embodiment. FIG. 4 is a diagram illustrating a sectional structure of the image display panel according to the first embodiment. As illustrated in FIG. 1, in the image display panel 40, $P_0 \times Q_0$ pixels 48 are arrayed in a two-dimensional matrix manner (where $P_0$ pixels in a row direction and $Q_0$ pixels in a column direction). Pixels 48 may be arrayed in a staggered arrangement manner.

The pixel 48 includes a plurality of sub-pixels 49, and lighting drive circuits of the sub-pixels 49 illustrated in FIG. 2 are arrayed in a two-dimensional matrix manner. As illustrated in FIG. 2, the lighting drive circuit includes a control transistor Tr1, a drive transistor Tr2, and a charge holding capacitor C1. A gate of the control transistor Tr1 is coupled with a scanning line SCL, a source of the control transistor Tr1 is coupled with a signal line DTL, and a drain of the control transistor Tr1 is coupled with a gate of the drive transistor Tr2. One end of the charge holding capacitor C1 is coupled with the gate of the drive transistor Tr2, and the other end of the charge holding capacitor C1 is coupled with a source of the drive transistor Tr2. The source of the drive transistor Tr2 is coupled with a power line PCL, and a drain of the drive transistor Tr2 is coupled with an anode of an organic light emitting diode E1 as a self-emitting body. A cathode of the organic light emitting diode E1 is coupled with a reference potential (for example, an earth). FIG. 2 illustrates an example in which the control transistor Tr1 is an n-channel transistor and the drive transistor Tr2 is a p-channel transistor. However, polarities of the respective transistors are not limited to the example. The polarities of the control transistor Tr1 and the drive transistor Tr2 may be determined as needed.

As illustrated in FIG. 3, the pixel 48 includes a first sub-pixel 49R, a second sub-pixel 49G, a third sub-pixel 49B, and a fourth sub-pixel 49W. The first sub-pixel 49R displays red as a first primary color. The second sub-pixel 49G displays green as a second primary color. The third sub-pixel 49B displays blue as a third primary color. The fourth sub-pixel 49W displays white as a fourth color that is different from the first to third colors. The first to fourth colors are not limited to red, green, blue, and white, and any colors such as an additional color can be selected. Hereinafter, when it is not necessary to distinguish the first sub-pixel 49R, the second sub-pixel 49G, the third sub-pixel 49B, and the fourth sub-pixel 49W, these sub-pixels are referred to as sub-pixel 49.

As illustrated in FIG. 4, the image display panel 40 includes a substrate 51, insulating layers 52 and 53, a reflecting layer 54, a lower electrode 55, a self-emitting layer 56, an upper electrode 57, an insulating layer 58, an insulating layer 59, a color filter 61 as a color converting layer, a black matrix 62 as a shading layer, and a substrate 50. The substrate 51 is a semiconductor substrate such as silicon, a glass substrate, a resin substrate, or the like, and forms or holds the above-described light drive circuit and the like. The insulating layer 52 is a protecting layer that protects the lighting drive circuit and the like, and silicon oxide, silicon nitride, or the like can be used. The lower electrode 55 is a conductor provided in each of the first sub-pixel 49R, the second sub-pixel 49G, the third sub-pixel 49B, and the fourth sub-pixel 49W, and serving as an anode (positive electrode) of the organic light emitting diode E1.

The lower electrode 55 is a transparent electrode made of a light-transmissive conductive material (light-transmissive conductive oxide) such as indium tin oxide (ITO). The insulating layer 53 is an insulating layer called bank, and which defines boundaries of the first sub-pixel 49R, the second sub-pixel 49G, the third sub-pixel 49B, and the fourth sub-pixel 49W. The reflecting layer 54 is made of a glossy metal material that reflects light from the self-emitting layer 56, such as silver, aluminum, or gold. The self-emitting layer 56 contains an organic material, and includes a hole injection layer, a hole transport layer, a light emitting layer, an electron transport layer and an electron injection layer (not illustrated).

(Hole Transport Layer)

As a layer that generates a positive hole, it is favorable to use a layer that includes an aromatic amine compound and a substance indicating electron acceptability thereto. The aromatic amine compound is a substance having aryl-amine skeleton. Among the aromatic amine compounds, in particular, one containing triphenylamine skeleton and having a molecular weight of 400 or more is favorable. Among the aromatic amine compounds containing triphenylamine skeleton, in particular, one containing a condensed aromatic ring such as a naphthyl group is favorable. Use of the aromatic amine compound including the triphenylamine and the condensed aromatic ring in skeleton improves heat resistance properties of a light-emitting element. Specific examples of the aromatic amine compound includes 4,4'-bis[N-(1-naphthyl)-N-phenylamino]biphenyl (abbr., α-NPD), 4-4'-bis[N-(3-methylphenyl)-N-phenylamino]biphenyl (abbr., TPD), 4,4',4"-tris(N, N-diphenylamino)triphenylamine (abbr., TDATA), 4,4',4"-tris[N-(3-methylphenyl)-N-phenylamine] triphenylamine (abbr., MTDATA), 4-4'-bis[N-{4-(N, N-di-m-tolylamino)phenyl}-N-phenylamino]biphenyl (abbr., DNTPD), 1,3,5-tris[N, N-di(m-tolyl)-animo]benzene (abbr., m-MTDAB), 4,4',4"-tris(N-carbazolyl)triphenylamine (abbr., TCTA), 2-3-bis(4-diphenylaminophenyl) quinoxaline (abbr., TPAQn), 2,2',3,3'-tetrakis(4-diphenylaminophenyl)-6,6'-bisquinoxaline (abbr., D-TriPhAQn), 2-3-bis {4-[N-(1-naphthyl)-N-phenylamino]phenyl}-dibenzo[f,h] quinoxaline (abbr., NPADiBzQn), and the like. The substance indicating electron acceptability to the aromatic amine compound is not especially limited, and for example, molybdenum oxide, vanadium oxide, 7,7,8,8-tetracyanoquinodimethane (abbr., TCNQ), 2,3,5,6-tetrafluoro-7,7,8,8-tetracyanoquinodimethane (abbr., F4-TCNQ), or the like can be used.

(Electron Injection Layer and Electron Transport Layer)

An electron transport substance is not especially limited, and for example, a metal complex compound such as tris(8-quinolinato)aluminum (abbr., Alq3), tris(4-methyl-8-quinolinato)aluminum (abbr., Almq3), bis(10-hydroxybenzo[h]-quinolinato)beryllium (abbr., BeBq2), bis(2-methyl-8-quinolinato)-4-phenylphenolatoalminium (abbr., BAlq), bis[2-(2-hydroxyphenyl)benzoxazolato]zinc (abbr., Zn(BOX)2), bis[2-(2-hydroxyphenyl)benzothiazolate]zinc (Zn(BTZ)2), and the like, as well as 2-(4-biphenyl)-5-(4-tert-butylphenyl)-1,3,4-oxydiazole (abbr., PBD), 1,3-bis[5-(p-tert-butylphenyl)-1,3,4-oxydiazole-2-yl]benzene (abbr., OXD-7), 3-(4-tert-butylphenyl)-4-phenyl-5-(4-biphenylyl)-1,2,4-triazole (abbr., TAZ), 3-(4-tert-butylphenyl)-4-(4-ethylphenyl)-5-(4-biphenylyl)-1,2,4-triazole (abbr., p-EtTAZ), bathophenanthroline (abbr., BPhen), bathocuproin (abbr., BCP) or the like can be used. A substance indicating electron-donating ability to the electron transport substance is not especially limited, and for example, alkali metal such as lithium or cesium, alkali earth metal such as magnesium or calcium, or rare earth metal such as erbium or ytterbium can be used. Alternatively, as the substance indicating electron-donating ability to the electron transport substance, a substance selected from among alkali metal oxides and alkali earth metal oxides such as lithium oxide (Li2O), calcium oxide (CaO), sodium oxide (Na2O), potassium oxide (K2O) and magnesium oxide (MgO) may be used.

(Light Emitting Layer)

To obtain red-based light emitting, a substance that exhibits light emitting having a spectrum peak from 600 nm to 680 nm, such as 4-dicyanomethylene-2-isopropyl-6-[2-(1,1,7,7-tetramethyljulolidine-9-yl)ethenyl]-4H-pyran (abbr., DCJTI), 4-dicyanomethylene-2-methyl-6-[2-(1,1,7,7-tetramethyljulolidine-9-yl)ethenyl]-4H-pyran (abbr., DCJT), 4-dicyanomethylene-2-tert-butyl-6-[2-(1,1,7,7-tetramethyljulolidine-9-yl)ethenyl]-4H-pyran (abbr., DCJTB), periflanthene, 2,5-dicyano-1,4-bis[2-(10-methoxy-1,1,7,7-tetramethyljulolidine-9-yl)ethenyl]benzene, can be used. To obtain green-based light emitting, a substance that exhibits light emitting having a spectrum peak from 500 nm to 550 nm, such as N,N'-dimethylquinacridone (abbr., DMQd), coumalin 6, coumalin 545T, or tris(8-quinolinato)aluminum (abbre., Alq3) can be used. To obtain blue-based light emitting, a substance that exhibits light emitting having a spectrum peak from 420 nm to 500 nm, such as 9,10-bis(2-naphthyl)-tert-butylanthracene (abbr., t-BuDNA), 9,9'-bianthryl, 9,10-diphenylanthracene (abbr., DPA), 9,10-bis(2-naphthyl)anthracene (abbr., DNA), bis(2-methyl-8-quinolinato)-4-phenylphenolato-gallium (abbr., BGaq), or bis(2-methyl-8-quinolinato)-4-phenylphenolato-aluminum (abbr., BAlq) can be used. Other than the substance emitting fluorescence, a substance emitting phosphorescence such bis[2-(3,5-bis(trifluoromethyl)phenyl)pyridinato-N,C2']iridium (III) picolinate (abbr., Ir(CF3ppy)2(pic)), bis[2-(4,6-difluorophenyl)pyridinato-N,C2']iridium (III) acetylacetonate (abbr., FIr(acac)), bis[2-(4,6-difluorophenyl)pyridinato-N,C2']iridium (III) picolinate (abbr., FIr(pic)), or tris(2-phenylpyridinato-N,C2')iridium (abbr., Ir(ppy)3) can be used.

The upper electrode 57 is a light-transmissive electrode made of a light-transmissive conductive material (light-transmissive conductive oxide) such as indium tin oxide (ITO). In the present embodiment, ITO has been exemplified as the light-transmissive conductive material. However, the light-transmissive conductive material is not limited thereto. As the light-transmissive conductive material, a conductive material having another composition such as indium zinc oxide (IZO) may be used. The upper electrode 57 serves as a cathode (negative electrode) of the organic light emitting diode E1. The insulating layer 58 is a sealing layer that seals the upper electrode 57, and silicon oxide, silicon nitride, or the like can be used. The insulating layer 59 is a planarizing layer that suppresses a step caused by the bank, and silicon oxide, silicon nitride, or the like can be used. The substrate 50 is a light-transmissive substrate that protects the entire image display panel 40, and a glass substrate can be used, for example. FIG. 4 illustrates, but is not limited to, an example in which the lower electrode 55 is an anode (positive electrode) and the upper electrode 57 is a cathode (negative electrode). The lower electrode 55 may be a cathode and the upper electrode 57 may be an anode, and in that case, the polarity of the drive transistor Tr2 electrically coupled with the lower electrode 55 can be appropriately changed. Further, the stacking order of the carrier injection layer (the hole injection layer and the electron injection layer), the carrier transport layer (the hole transport layer and the electron transport layer), and the light emitting layer can be appropriately changed.

The image display panel 40 is a color display panel, and in which the color filter 61 that transmits light of a color in accordance with the color of the sub-pixel 49, of light emitting components of the self-emitting layer 56, is arranged between the sub-pixel 49 and an observer of an image. The image display panel 40 can emit light of colors corresponding to red, green, blue, and while. The color filter 61 may not be arranged between the fourth sub-pixel 49W corresponding to white and the observer of an image. In the image display panel 40, the light emitting components of the self-emitting layer 56 can emit the light of the respective colors of the first sub-pixel 49R, the second sub-pixel 49G, the third sub-pixel 49B, and the fourth sub-pixel 49W, without through a color converting layer such as the color filters 61. For example, in the image display panel 40, the fourth sub-pixel 49W may include a transparent resin layer, in place of the color filter 61 for color adjustment. As described above, the image display panel 40 includes the transparent resin layer, thereby to suppress a large gap caused in the fourth sub-pixel 49W.

Figure 5:
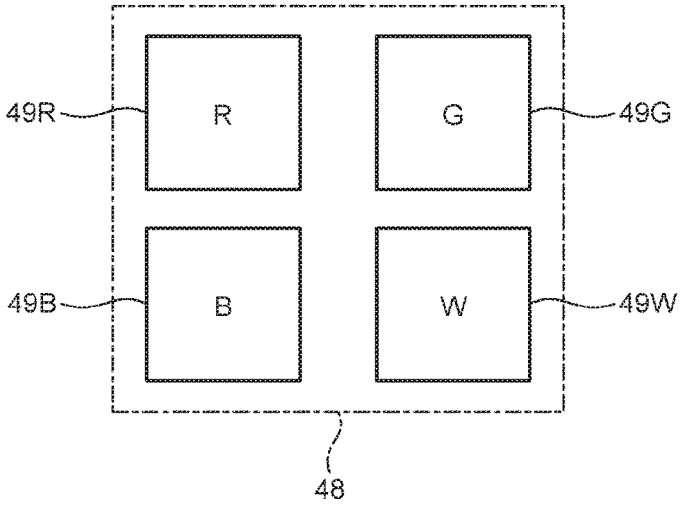
FIG. 5 is a diagram illustrating another array of the sub-pixels of the image display panel according to the first embodiment.

FIG. 5 is a diagram illustrating another array of the sub-pixels of the image display panel according to the first embodiment. In the image display panel 40, the pixels 48 in which the sub-pixels 49 including the first sub-pixel 49R, the second sub-pixel 49G, the third sub-pixel 49B, and the fourth sub-pixel 49W are combined in a two by two matrix manner are arranged in a matrix manner. As described above, in the image display panel 40, the array of the sub-pixels 49 in the pixel 48 may be arbitrarily set.

(Configuration of Image Display Panel Drive Unit)

The image display panel drive unit 30 is a control device of the image display panel 40, and includes a signal output circuit 31, a scanning circuit 32, and a power source circuit 33. The signal output circuit 31 is electrically coupled with the image display panel 40 by a signal line DTL. The signal output circuit 31 holds an input image output signal, and sequentially outputs the image output signal to the sub-pixels 49 of the image display panel 40. The scanning circuit 32 is electrically coupled with the image display panel 40 by a scanning line SCL. The scanning circuit 32 selects the sub-pixel 49 in the image display panel, and controls ON and OFF of a switching element (for example, a thin film transistor (TFT)) for controlling an operation (light emitting intensity) of the sub-pixel 49. The power source circuit 33 supplies power to the organic light emitting diodes E1 of the sub-pixels 49 by the power line PCL.

(Configuration of Input Signal Output Unit)

Figure 6:
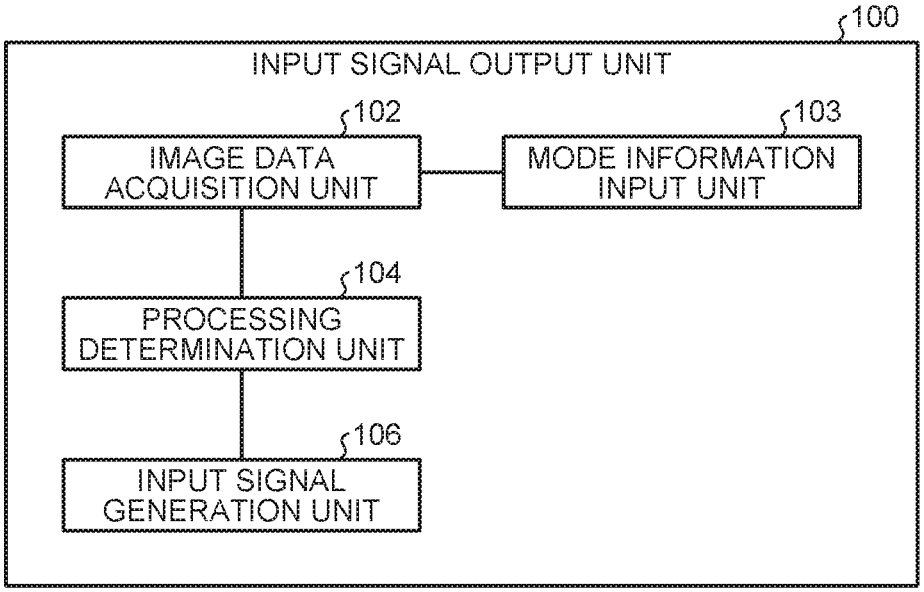
FIG. 6 is a block diagram for schematically describing a configuration of an input signal output unit according to the first embodiment.

Next, a configuration of the input signal output unit 100 will be described. FIG. 6 is a block diagram for schematically describing a configuration of an input signal output unit according to the first embodiment. The input signal output unit 100 is an application (software) that can perform an operation described below by a circuit included in the electronic apparatus 1. The input signal output unit 100 outputs a normal input signal D3 or a correction input signal D4 to the control unit 20. As illustrated in FIG. 6, the input signal output unit 100 includes an image data acquisition unit 102, a mode information input unit 103, a processing determination unit 104, and an input signal generation unit 106.

The image data acquisition unit 102 acquires image data D1 that is data of an image to be displayed in the display device 10. The image data acquisition unit 102 acquires the data of the image generated by another application, and a method of acquiring the image data D1 is arbitrary. For example, the data of the image may be acquired by communication with an outside, and the image data D1 may be generated by an operation of a program. The image data D1 is data including the normal input signal D3. The normal input signal D3 is a signal that includes the input signal data D2 for all of the pixels 48 of the image display panel 40, and does not include a display control code F which is described below. In the present embodiment, the normal input signal D3 may include another signal such as a clock signal. However, in the present embodiment, description of the another signal is omitted.

Figure 7:
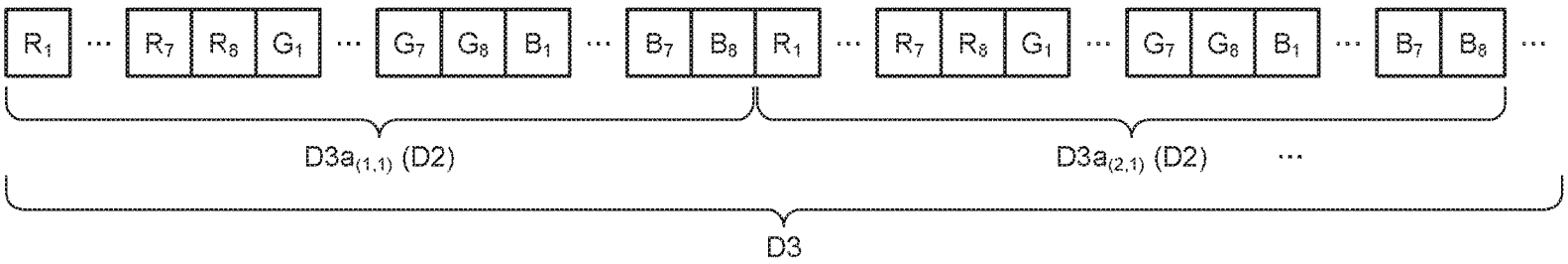
FIG. 7 is an explanatory diagram for describing input signal data and normal input signal.

FIG. 7 is an explanatory diagram for describing the input signal data and the normal input signal. The input signal data D2 is a plurality of numbers of bits of data, and is data including information of an input signal value for one pixel 48. As illustrated in FIG. 7, the input signal data D2 includes first input signal data (R1, . . . R7, and R8) that indicates information of input signal values to the first sub-pixels 49R in the corresponding pixel 48, second input signal data (G1, . . . G7, and G8) that indicates information of input signal values to the second sub-pixels 49G, and third input signal data (B1, . . . B7, and B8) that indicates information of input signal values to the third sub-pixels 49B. The first input signal data is 8-bit data in total from bit data R1 to bit data R8. The second input signal data is 8-bit data in total from bit data G1 to bit data G8. The third input signal data is 8-bit data in total from bit data B1 to bit data B8. Each bit data is 1-bit data, and includes numerical value information of 0 or 1. However, the numbers of bits of the first input signal data, the second input signal data, and the third input signal data are arbitrary.

A pixel input signal D3*a* is data including the input signal data D2 for one pixel 48. The normal input signal D3 is data in which the pixel input signals D3*a* of all of the pixels 48 in the image display panel 40 are collected. That is, the normal input signal D3 is data in which the pixel input signals $D3a_{(1,1)}$, $D3a_{(2,1)}$, . . . , $D3a_{(p,q)}$, . . . , and $D3a_{(P0,Q0)}$ are arrayed, where the pixel input signal D3*a* including the input signal data D2 for a pixel $48_{(p,q)}$ that is p-th pixel 48 in a row direction and is q-th pixel 48 in a column direction is $D3a_{(p,q)}$.

As described above, the normal input signal D3 is data configured such that the pixel input signals D3*a* including the information of the input signal data D2 of one pixel 48 are collected by one frame (all of the pixels 48 of the image display panel 40).

Information as to whether executing processing in a normal mode or executing processing in a correction mode is input by an operator to the mode information input unit 103. That is, the operator selects the normal mode or the correction mode to input whether performing processing in the normal mode or in the correction mode to the mode information input unit 103. To be specific, the operator inputs information indicating switching a mode to the mode information input unit 103 when wishing to switch a mode. For example, when the operator wishes to switch the mode to the correction mode in a case where the processing is being executed in the normal mode, the operator inputs the information indicating that the processing is to be executed in the correction mode (information indicating that the mode is to be switched) to the mode information input unit 103. Although details will be described below, the normal mode is a mode in which the normal input signal D3 is output to the control unit 20, and the control unit 20 generates the output signal based on the normal input signal D3. The correction mode is a mode in which the correction input signal D4 is output to the control unit 20, and the control unit 20 generates the output signal based on the correction input signal D4.

The processing determination unit 104 acquires the information as to whether the mode is the correction mode or the normal mode from the mode information input unit 103. When the mode is the correction mode, the processing determination unit 104 analyzes the image data D1 (input signal data D2), determines processing content to be performed for an image to be displayed, and generates display control data E. The processing determination unit 104 selects any of processing from two pieces of processing content including first processing and second processing. Although details will be described below, the first processing in the present embodiment is processing of converting the input signal values to the first sub-pixel 49R, the second sub-pixel 49G, and the third sub-pixel 49B into output signal values to the first sub-pixel 49R, the second sub-pixel 49G, the third sub-pixel 49B, and the fourth sub-pixel 49W by the display device 10, and making the luminance of a displayed image large. The second processing in the present embodiment is processing of converting the input signal values to the first sub-pixel 49R, the second sub-pixel 49G, and the third sub-pixel 49B into output signal values to the first sub-pixel 49R, the second sub-pixel 49G, the third sub-pixel 49B, and the fourth sub-pixel 49W, and not making the luminance of the displayed image large. The processing determination unit 104 does not perform the processing of determining the processing content in the normal mode.

To be more specific, the processing determination unit 104 segments the image display area 41 of the image display panel 40 into a plurality of areas 42. The area 42 is each of areas when the image display area 41 is divided into a plurality of areas. The processing determination unit 104 recognizes the areas 42 where different images are displayed as different areas 42, when the image data D1 includes data of a plurality of images. Here, the data of a plurality of images is pieces of data of different images acquired from mutually different applications, for example. The data of a plurality of images is pieces of data of images to be displayed in separate windows, for example. The data of a plurality of images may be an image to be displayed by a certain application and a background image of the image, for example. The method of dividing the areas 42 by the processing determination unit 104 is not limited to the method of recognizing the areas 42 where different images are displayed as the different areas 42, as long as the method segments the image display area 41 into the plurality of areas 42 by a predetermined algorithm based on the image data D1. The method may be dividing one image into the plurality of areas 42.

Then, the processing determination unit 104 determines the processing content to be applied for each segmented area 42 by a predetermined algorithm. The processing determination unit 104 determines that the first processing is to be performed, for the area 42 of an image for which execution of the first processing has been determined by the predetermined algorithm. The processing determination unit 104 determines that the second processing is to be performed, for the area 42 of an image for which execution of the second processing has been determined by the predetermined algorithm. For example, the processing determination unit 104 determines that the area 42 where an image operated by the operator is to be displayed is an active window, and performs predetermined processing (here, the first processing) on the area 42. The processing determination unit 104 determines that the area 42 where an image not operated by the operator is to be displayed is not the active window, and performs another processing (here, the second processing) on the area 42. In this case, the processing determination unit 104 may determine that the area 42 corresponding to an image to be displayed on the top as the active window, when a plurality of images is superimposed. The processing determination unit 104 may determine that the area 42 corresponding to an image to which information is input by the operator as the active window. For example, the processing determination unit 104 may determines that the predetermined processing (here, the first processing) is to be performed for the area 42 corresponding to an image to be displayed by a predetermined application. The processing determination unit 104 may determines that another processing (here, the second processing) is to be performed for the area 42 corresponding to the background image.

Figure 8:
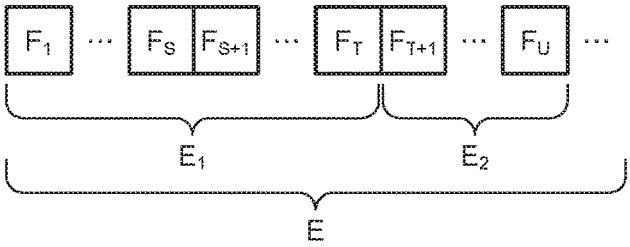
FIG. 8 is a diagram for describing display control data.

The display control data E generated by the processing determination unit 104 includes position information of each of the areas 42 (the positions of the area 42 in the image display area 41) and area processing information that is information that specifies the processing content for each area 42 (information that indicates the processing content performed in the area 42). The display control data E is a plurality of numbers of bits of data. FIG. 8 is a diagram for describing the display control data. The display control data E includes a plurality of area display control data $E_x$, as exemplarily illustrated by area display control data $E_1$ and $E_2$ of FIG. 8. The area display control data $E_1$ includes a plurality of display control codes $F_1, \ldots,$ and $F_U$. Hereinafter, when the display control codes are not distinguished, the display control codes are described as display control codes F. The display control code F is 1-bit data, and includes numerical value information of 0 or 1. The display control codes $F_1$ to $F_S$ are data that indicates the position information of the area 42. The display control codes $F_{S+1}$ to $F_T$ are data that indicates the processing content of the area 42 specified by the display control codes $F_1$ to $F_S$. The area display control data $E_2$ includes a plurality of display control codes $F_{T+1}, \ldots,$ and $F_U$, and is configured from a plurality of display control codes F including the position information and the area processing information of the area 42, which is different from the area display control data $E_1$. That is, the area display control data $E_x$ can be said to be data that indicates the processing content of one area 42. The display control data E includes the number of the area display control data $E_x$ corresponding to the number of the areas 42 where different processing is to be performed.

As described above, the display control data E is data in which the area display control data $E_x$ including the position information and the area processing information is arrayed for each corresponding area 42. However, the order of the array of the data is arbitrary as long as the data includes the position information and the area processing information of each area 42 where different processing is to be performed. Further, the display control data E is the plurality of numbers of bits of data including the plurality of display control codes F. However, the number of bits (the number of the display control codes F) is arbitrary.

In the case where the mode is the correction mode, the input signal generation unit 106 generates the correction input signal D4 based on the normal input signal D3 in the image data D1 and the display control codes F in the display control data E. In the case where the mode is the normal mode, the input signal generation unit 106 employs the normal input signal D3 in the image data D1 as the input signal for being output to the control unit 20 as it is.

Figure 9:
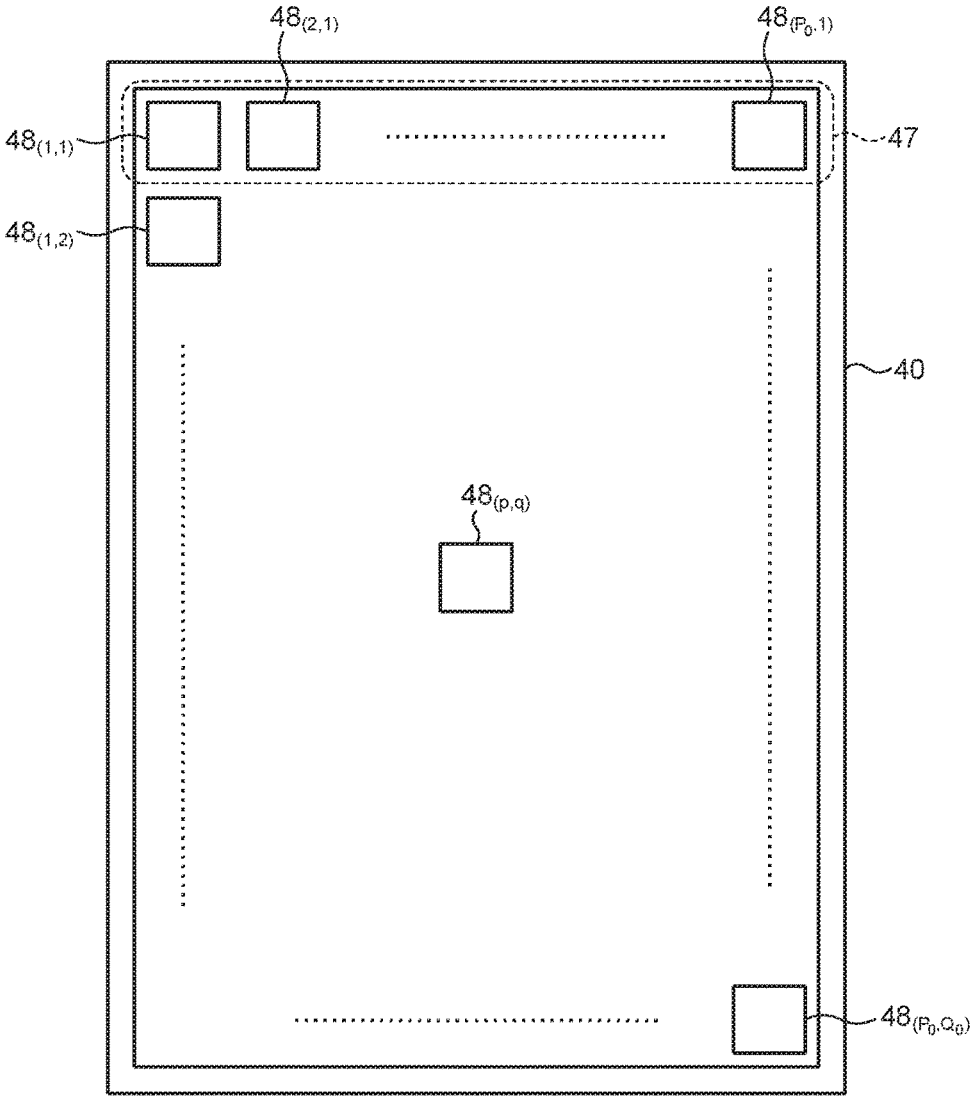
FIG. 9 is an explanatory diagram for describing generation of an input signal.
Figure 10:
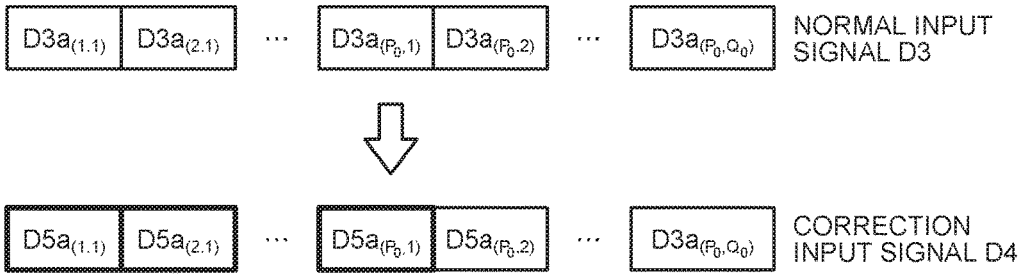
FIG. 10 is an explanatory diagram for describing generation of an input signal.

To be specific, in the case where the mode is the correction mode, the input signal generation unit 106 converts a part of the data in the normal input signal D3, that is, the pixel input signal D3*a* of a part of all of the pixels 48 into the control input signal D5*a*, thereby to generate the correction input signal D4. FIGS. 9 and 10 are explanatory diagrams for describing generation of the correction input signal. As illustrated in FIG. 9, a pixel group (pixels $48_{(1,1)}$, $48_{(2,1)}$, . . . , and $48_{(P0,1)}$) made of the pixels 48 in the first row in all of the pixels 48 in the image display panel 40 is a pixel group 47. As illustrated in FIG. 10, the input signal generation unit 106 converts the pixel input signals D3*a* (pixel input signals $D3a_{(1,1)}$, $D3a_{(2,1)}$, . . . , and $D3a_{(P0,1)}$) of the pixels 48 of the pixel group 47 into the control input signals D5*a* (control input signals $D5a_{(1,1)}$, $D5a_{(2,1)}$, . . . , and $D5a_{(P0,1)}$) to generate the correction input signal D4. In the correction input signal D4, signals corresponding to the pixel group 47 are the control input signals D5*a*, and signals corresponding to the pixels 48 other than the pixel group 47 remain in the pixel input signals D3*a*.

Figure 11:
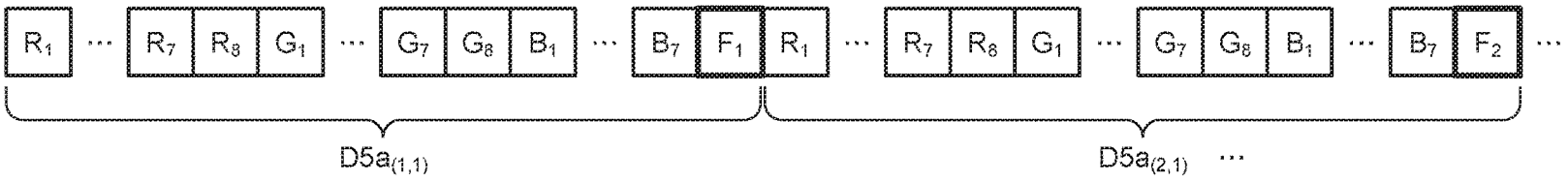
FIG. 11 is an explanatory diagram for describing a control input signal.

FIG. 11 is an explanatory diagram for describing the control input signal. The control input signal D5*a* is a signal obtained by converting a part of the input signal data D2 in the pixel input signal D3*a* into the display control code F. To be specific, as illustrated in FIG. 11, the control input signal D5*a* is a signal obtained by converting the bit data B8 that is the lowest bit data of the third input signal data in the input signal data D2 into the display control code F.

The input signal generation unit 106 divides the display control data E for each display control code F, and allocates the display control codes F in the display control data E to the respective pixels 48 in the pixel group 47 one by one. As illustrated in FIG. 11, the control input signal D5*a* is a signal obtained by converting the bit data B8 of the pixel input signal $D3a_{(1,1)}$ into the display control code $F_1$, and is a signal obtained by converting the bit data B8 of the pixel input signal $D3a_{(2,1)}$ into the display control code $F_2$.

The input signal generation unit 106 selects the pixels 48 in the first row as the pixel group 47. However, the pixel group 47 is not limited to the pixels 48 in the first row as long as the pixel group 47 is a part of all of the pixels 48. Further, the control input signal D5*a* is not limited to the a signal obtained by converting the bit data B8 in the input signal data D2 into the display control code F, as long as the data is obtained by converting at least a part of any of the first input signal data, the second input signal data, and the third input signal data into the display control code F. Note that the control input signal D5*a* is favorably obtained by converting the lowest bit data, that is, at least any of the bit data R8, G8, and B8, into the display control code F. In the present embodiment, one display control code F is allocated to the pixel input signal D3*a* of one pixel 48. However, a plurality of the display control codes F may be allocated to the pixel input signal D3*a* of one pixel 48. In this case, as the bit data in the input signal data D2 to be converted into the display control code F, the lower-side bit (the bit data B8 in the case of the third input signal data) is favorable. Further, the input signal data corresponding to a color with low luminance is favorable in the cases of the first input signal data, the second input signal data, and the third input signal data. That is, the third input signal data (blue) is the most favorable, the first input signal data (red) is next favorable, and the second input signal data (green) is next favorable. To sum up, as the bit data in the pixel input signal D3*a* to be converted into the display control code F, it is favorable to select the color with lower luminance when the color is displayed in a gradation value corresponding to the bit data. For example, it is favorable to select the bit data in order of the bit data B8, R8, G8, B7, R7, . . . , as the bit data to be converted into the display control code F. For example, it is favorable to replace the bit data B8 with the display control code F in a case of allocating one display control code F, and it is favorable to replace the bit data B8 and R8 with the display control codes F in a case of allocating two display control codes F. Further, it is favorable to replace the bit data B8, R8, and G8 with the display control codes F in a case of allocating three display control codes F. However, the bit data B8, R8, and B7 may be replaced with the display control codes F. A case of replacing the bit data B8, R8, and B7 with the display control codes F may be a case where the luminance in the gradation value corresponding to the bit data G8 is larger than the luminance in the gradation value corresponding to the bit data B7.

As described above, in the correction input signal D4 generated by the input signal generation unit 106, the signal to a part of the pixels 48 in the image display panel 40 is the control input signal D5*a*, and the signal to another part of the pixels 48 is the pixel input signal D3*a* made of only the input signal data D2 for the pixels 48. The control input signal D5*a* is a plurality of bits of data, and a part of the data is the input signal data D2 for causing the corresponding pixel to display a predetermined color, and another part of data is the display control code F.

As described above, the input signal output unit 100 outputs the normal input signal D3 to the control unit 20 in the normal mode, and outputs the correction input signal D4 to the control unit 20 in the correction mode.

(Configuration of Control Unit)

Figure 12:
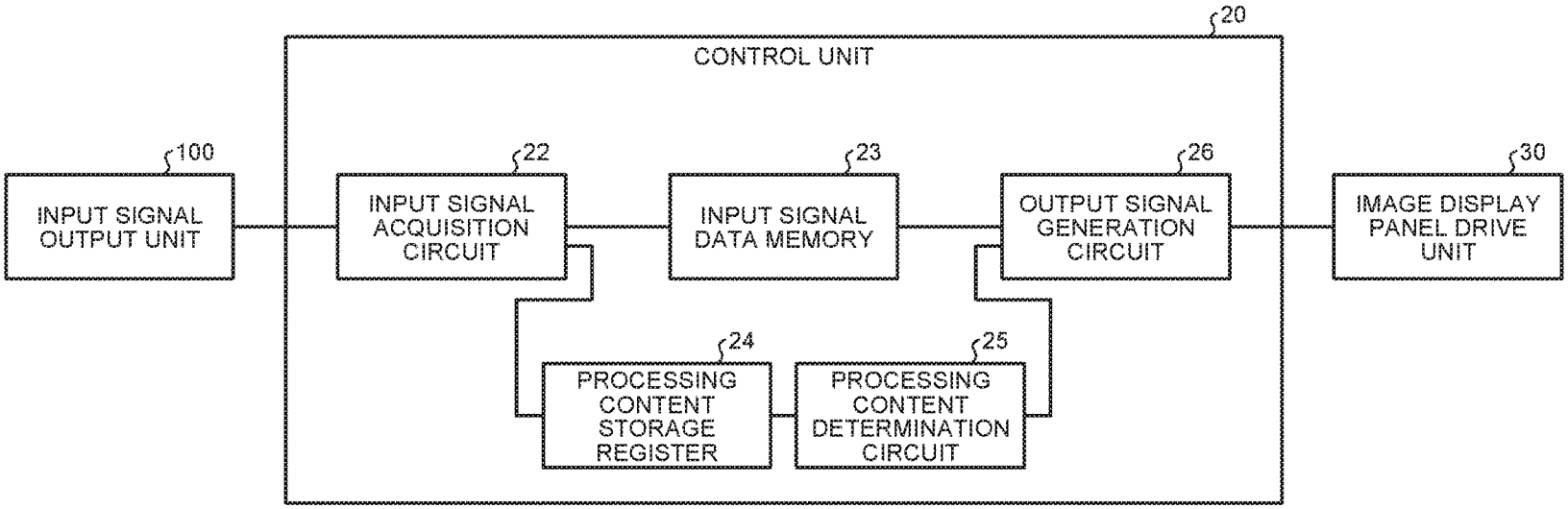
FIG. 12 is a block diagram schematically illustrating a configuration of a control unit.

Next, the control unit 20 will be described. The control unit 20 acquires the normal input signal D3 or the correction input signal D4 from the input signal output unit 100, and generates an output signal. The control unit 20 outputs the generated output signal to the image display panel drive unit 30. FIG. 12 is a block diagram schematically illustrating a configuration of the control unit. As illustrated in FIG. 12, the control unit 20 includes an input signal acquisition circuit 22 as an input signal acquisition unit, an input signal data memory 23, a processing content storage register 24, a processing content determination circuit 25 as a processing determination unit, and an output signal generation circuit 26 as an output signal generation unit.

The input signal acquisition circuit 22 acquires the normal input signal D3 or the correction input signal D4 from the input signal generation unit 106 in the input signal output unit 100. The input signal acquisition circuit 22 writes mode information (information as to whether the mode is the normal mode or the correction mode) from the mode information input unit 103 in a register (not illustrated) of the control unit 20 with an instruction command. When the content written in the register indicates the normal mode, the input signal acquisition circuit 22 recognizes that the signal from the input signal output unit 100 is the normal input signal D3, and outputs the normal input signal D3 to the output signal generation circuit 26.

When the content written in the register indicates the correction mode, the input signal acquisition circuit 22 recognizes that the signal from the input signal output unit 100 is the correction input signal D4, extracts the input signal data D2 from the correction input signal D4, and outputs the input signal data D2 to the input signal data memory 23. The input signal acquisition circuit 22 extracts the display control code F in the control input signal D5*a* from the correction input signal D4, and outputs the display control code F to the processing content storage register 24. The input signal acquisition circuit 22 may acquire information, from the input signal output unit 100, as to which bit data in the control input signal D5*a* is the display control code F, or which bit data in the control input signal D5*a* is extracted may be set in advance.

The input signal data memory 23 is a memory that temporarily stores the input signal data D2 from the input signal acquisition circuit 22. The input signal data memory 23 temporarily stores the input signal data D2, thereby to synchronize output timing of the data of the processing content determined by the processing content determination circuit 25 described below, and the data of the input signal data D2 to the output signal generation circuit 26.

The processing content storage register 24 is a register that acquires the display control code F from the input signal acquisition circuit 22 and stores the display control code F. To be more specific, the processing content storage register 24 cumulatively stores the display control codes F included in all of the pixels 48 in the pixel group 47 in order, thereby to store the position information and the area processing information that are information included in the plurality of display control codes F. For example, the processing content storage register 24 cumulatively stores the display control codes in order of the display control codes $F_1$, $F_2$, . . . , thereby to reconstruct the display control data E as illustrated in FIG. 8, and store the display control data E.

The processing content determination circuit 25 reads the position information and the area processing information (here, the display control data E) stored in the processing content storage register 24, and determines the processing content (in the present embodiment, the first processing or the second processing) in the correction mode. To be specific, the processing content determination circuit 25 analyzes the position information in the display control data E stored in the processing content storage register 24, and reads the information of the position of the area 42, that is, the positions of the pixels 48 (coordinates of the pixels 48) included in the area 42. Further, the processing content determination circuit 25 analyzes the area processing information in the display control data E stored in the processing content storage register 24, and reads the processing content to be executed for the pixels 48 in the area 42. For example, the processing content determination circuit 25 reads the position information of the pixels 48 included in the area 42 based on the display control codes $F_1$ to $F_s$ stored in the processing content storage register 24. Further, the processing content determination circuit 25 reads the processing content to be executed for the pixels 48 in the area 42 based on the display control codes $F_{s+1}$ to $F_T$ stored in the processing content storage register 24.

The processing content determination circuit 25 generates a processing information signal including information of the processing content (in the present embodiment, the first processing or the second processing) and the position information of the pixels 48 in the area 42 where the processing is to be performed, from the read position information and area processing information.

The input signal data memory 23, the processing content storage register 24, and the processing content determination circuit 25 described above perform the above-described processing in a case of performing correction processing, and do not perform the above-described processing in a case of performing normal processing.

The output signal generation circuit 26 is a circuit in which a calculation circuit is incorporated. In the correction mode, the output signal generation circuit 26 acquires the input signal data D2 of the pixels 48 from the input signal data memory 23. In the correction mode, the output signal generation circuit 26 acquires the processing information signal from the processing content determination circuit 25. The output signal generation circuit 26 performs the processing (in the present embodiment, the first processing or the second processing) specified by the processing information signal for the input signal data D2 of the pixel 48 specified by the processing information signal to generate an output signal of the specified pixel 48. The output signal generation circuit 26 applies the same processing content to the pixels 48 in the same area 42 and generates the output signals to all of the pixels 48 in one frame. The processing of generating the output signal in the correction mode will be described below.

In the normal mode, the output signal generation circuit 26 acquires the normal input signal D3 from the input signal acquisition circuit 22 through the input signal data memory 23, and performs the predetermined processing determined in advance to generate the output signal. In the normal mode, the output signal generation circuit 26 may directly acquire the normal input signal D3 from the input signal acquisition circuit 22. The processing of generating the output signal in the normal mode will be described below. In the present embodiment, the predetermined processing content determined in advance is written in the register (not illustrated) coupled with the processing content determination circuit 25. In the normal mode, the processing content determination circuit 25 outputs the information of the predetermined processing content written in the register to the output signal generation circuit 26.

(Determination of Processing Content)

Next, a method of determining the processing content by the control unit 20 in the correction mode will be described. The control unit 20 extracts the display control code F in the control input signal D5*a* from the correction input signal D4 by the input signal acquisition circuit 22, and outputs the display control code F to the processing content storage register 24. The processing content storage register 24 stores all of the display control codes F in the pixel group 47 in order, thereby to store the position information and the area processing information that are information included in the display control codes F. The processing content determination circuit 25 reads the information of the positions of the pixels 48 included in the area 42 based on the position information stored in the processing content storage register 24. The processing content determination circuit 25 determines the processing content to be executed for the pixels 48 in the area 42 based on the area processing information stored in the processing content storage register 24. The processing content determination circuit 25 generates the processing information signal that indicates the processing content and the position information of the pixels 48 in the area 42 where the processing is to be performed, from the read information. The output signal generation circuit 26 executes the processing based on the processing information signal. Accordingly, the control unit 20 can execute different processing content in the different area 42 in the image display panel 40.

Figure 13:
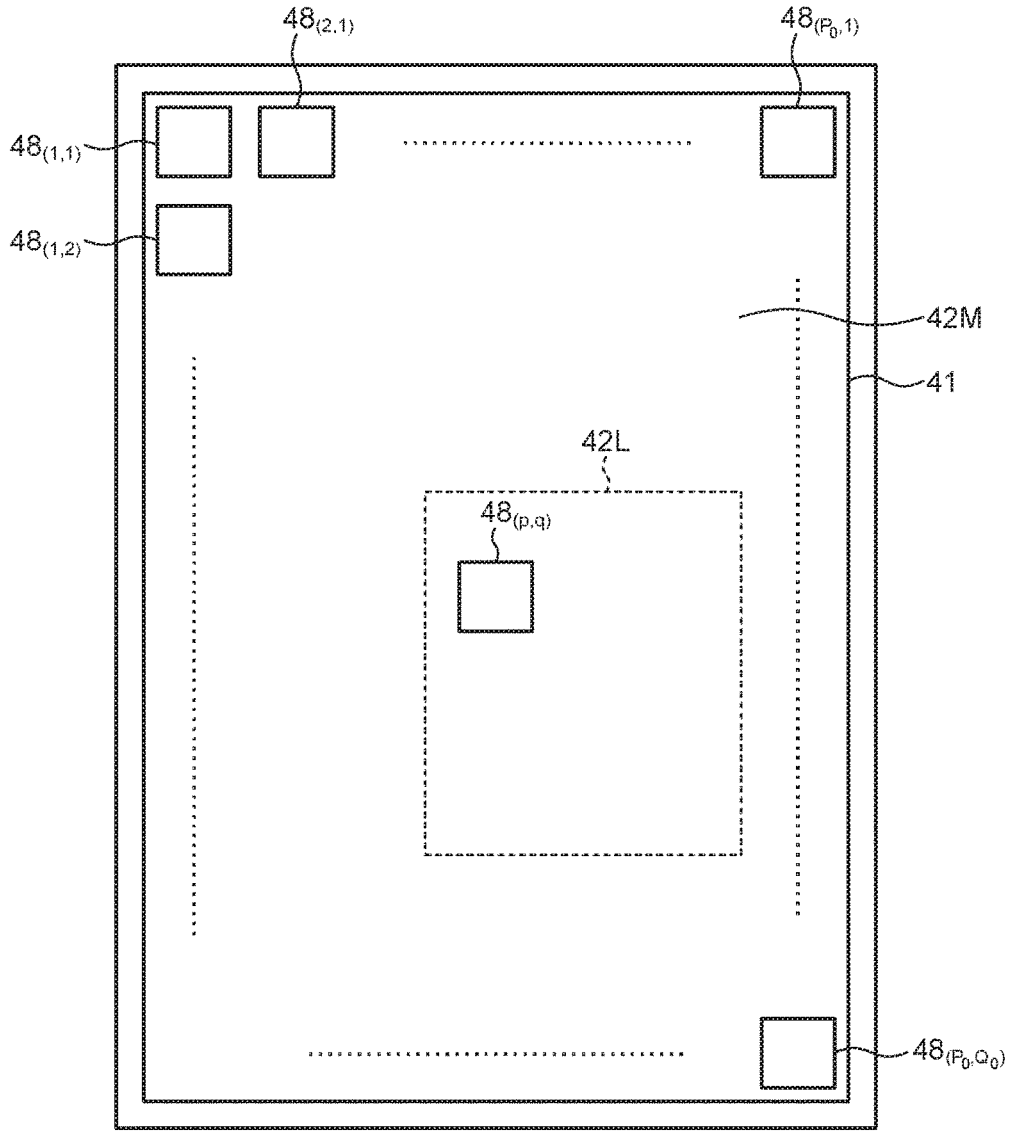
FIG. 13 is an explanatory diagram for describing a method of determining processing in different areas.

Hereinafter, an example of a method of determining processing in a different area 42 will be described. FIG. 13 is an explanatory diagram for describing a method of determining processing in a different area. As illustrated in FIG. 13, in this example, the first processing is performed for an area 42L in the image display panel 40, and the second processing is performed for an area 42M that is an area other than the area 42L. In the area display control data $E_1$ illustrated in FIG. 8 in this example, the display control codes $F_1$ to $F_s$ include the information of the positions of the pixels 48 included in the area 42L. In the area display control data $E_1$, the display control codes $F_{S+1}$ to $F_T$ include the information of processing to be executed for the pixels 48 included in the area 42L, here, information that indicates that the first processing is to be performed. The processing content storage register 24 stores the display control codes $F_1$ to $F_s$ included in the control input signal D5*a* of the pixels 48 in the pixel group 47 in order. The processing content determination circuit 25 analyzes the display control codes $F_1$ to $F_s$, and reads the information of the positions of the pixels 48 included in the area 42L. Further, the processing content storage register 24 stores the display control codes $F_{S+1}$ to $F_T$ included in the control input signal D5*a* of the pixels 48 in the pixel group 47 in order. The processing content determination circuit 25 analyzes the display control codes $F_{S+1}$ to $F_T$, and determines the processing content to be executed for the pixels 48 included in the area 42L as the first processing.

Further, in the area display control data $E_2$ illustrated in FIG. 8 in this example, the display control codes $F_{T+1}$ to $F_U$ include the information of the positions of the pixels 48 included in the area 42M, and include the information of processing to be executed for the pixels 48 included in the area 42M, here, the information indicating that the second processing is to be performed. The processing content determination circuit 25 analyzes the display control codes $F_{T+1}$ to $F_U$ included in the control input signal D5*a* of the pixels 48 in the pixel group 47, and determines the processing to be executed for the pixels 48 in the area 42M as the second processing. Accordingly, in this example, the first processing can be performed for the area 42L and the second processing can be performed for the area 42M.

(Processing of Generating Output Signal)

Next, processing of generating an output signal by the control unit 20 will be described. The control unit 20 generates the output signal by the output signal generation circuit 26. To be specific, the output signal generation circuit 26 executes the processing of the processing content specified in the processing information signal to the input signal data D2 of the pixel 48 in the area 42 specified by the processing content determination circuit 25, and generates the output signal, in the correction mode. The output signal generation circuit 26 generates the output signals to all of the pixels 48 in one frame while executing the same processing content for the pixels 48 in the same area 42. Further, the output signal generation circuit 26 executes the predetermined processing determined in advance to the normal input signal D3 and generate the output signal, in the normal mode.

Hereinafter, processing of generating the output signal by the output signal generation circuit 26 will be specifically described. As described above, in the first embodiment, the processing content in the correction mode is either the first processing or the second processing. First, generation of the output signal by the first processing in the correction mode will be described.

(Generation of Output Signals by First Processing)

Hereinafter, the input signal value of the (p, q)-th pixel $\mathbf{48}_{(p,\ q)}$ read from the first input signal data in the input signal data D2 to the first sub-pixel 49R is an input signal value $x_{1\text{-}(p,\ q)}$. The input signal value of the pixel $\mathbf{48}_{(p,\ q)}$ to the second sub-pixel 49G is an input signal value $x_{2\text{-}(p,\ q)}$. The input signal value of the pixel $\mathbf{48}_{(p,\ q)}$ to the third sub-pixel 49B is an input signal value $x_{3\text{-}(p,\ q)}$. The output signal generation circuit 26 executes luminance expansion processing for the input signal value $x_{1\text{-}(p,\ q)}$, the input signal value $x_{2\text{-}(p,\ q)}$, and the input signal value $x_{3\text{-}(p,\ q)}$ thereby to generate an output signal (signal value $X_{1\text{-}(p,\ q)}$) of the first sub-pixel for determining display gradation of the first sub-pixel $\mathbf{49}R_{(p,\ q)}$ an output signal (signal value $X_{2\text{-}(p,\ q)}$) of the second sub-pixel for determining display gradation of the second sub-pixel $\mathbf{49}G_{(p,\ q)}$ an output signal (signal value $X_{3\text{-}(p,\ q)}$) of the third sub-pixel for determining display gradation of the third sub-pixel $\mathbf{49}B_{(p,\ q)}$ and an output signal (signal value $X_{4\text{-}(p,\ q)}$) of the fourth sub-pixel for determining display gradation of the fourth sub-pixel $\mathbf{49}W_{(p,\ q)}$. The output signal generation circuit 26 outputs the generated output signals to the image display panel drive unit 30 as output signals.

In the pixels 48 in the pixel group 47 (the pixels 48 in the first row), the bit data B8 of the third input signal data has been replaced with the display control code F. Therefore, the third input signal data is 7-bit data of the bit data B1 to B7, instead of the 8-bit data. The output signal generation circuit 26 complements the value of the replaced bit data B8 with a predetermined value, and obtains the 8-bit data. The output signal generation circuit 26 calculates the input signal value $x_{3\text{-}(p,\ q)}$ based on this 8-bit data. When the value of the 7-bit data of the third input signal is zero, that is, when all of the values of the bit data B1 to B7 are zero, the output signal generation circuit 26 sets the value of the bit data B8 to zero. When the value of the 7-bit data of the third input signal data is 1 or more, that is, when at least any of the values of the bit data B1 to B7 is 1, the output signal generation circuit 26 sets the value of the bit data B8 to 1. For example, when the bit data B1 is 1 and the bit data B2 to B7 are 0, the output signal generation circuit 26 sets the value of the bit data B8 to 1 and the input signal value $x_{3\text{-}(p\ q)}$ to 129. Hereinafter, the first processing by the output signal generation circuit 26 will be specifically described.

Figure 14:
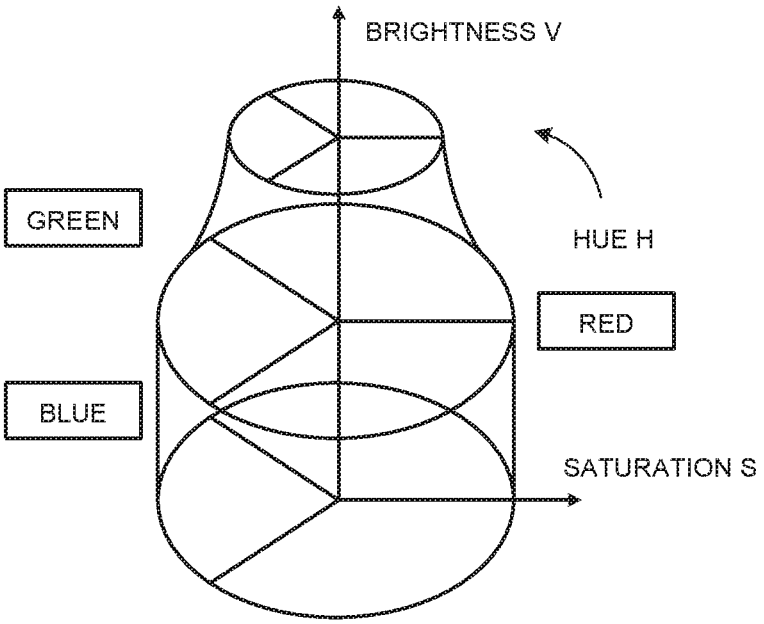
FIG. 14 is a conceptual diagram of an extended HSV (hue-saturation-value, value is also called brightness) color space extendable in the display device of the first embodiment.
Figure 15:
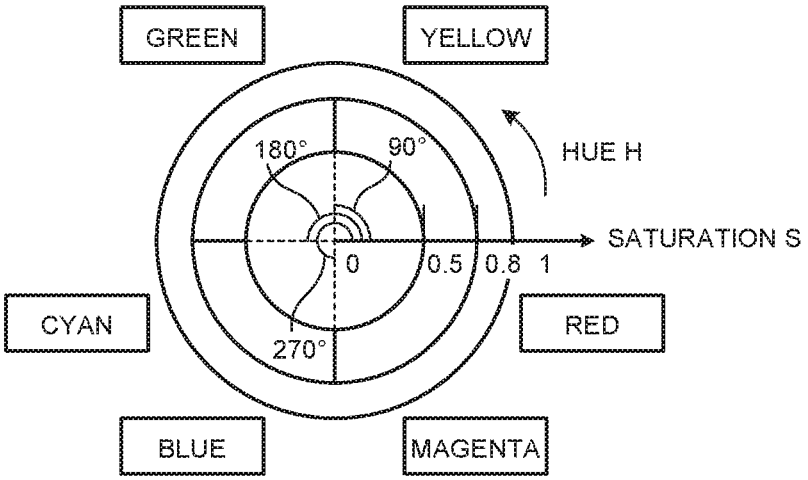
FIG. 15 is a conceptual diagram illustrating a relationship between hue and saturation of the extended HSV color space.

In the present embodiment, the first processing is processing (luminance expansion processing) of lighting the fourth sub-pixel 49W to make the luminance large, and displaying an image. FIG. 14 is a conceptual diagram of an extended HSV (hue-saturation-value, value is also called brightness) color space extendable in the display device of the first embodiment. FIG. 15 is a conceptual diagram illustrating a relationship between hue and saturation of the extended HSV color space. The display device 10 includes the fourth sub-pixel 49W that outputs the fourth color (white) to the pixel 48, and thus a dynamic range of a value (also called as brightness) in the extended color space (the HSV color space in the first embodiment) is enlarged, as illustrated in FIG. 14. That is, as illustrated in FIG. 14, the enlarged color space extended by the display device 10 has a shape of a solid body being placed on a columnar color space that can be displayed by the first sub-pixel 49R, the second sub-pixel 49G, and the third sub-pixel 49B, where the shape of the solid body in a cross section including a saturation axis and a brightness axis where the maximum value of the brightness becomes lower as the saturation becomes higher is an approximately trapezoidal shape with curved oblique sides. A maximum value Vmax (S) of the brightness using the saturation S in the enlarged color space (the HSV color space in the first embodiment) enlarged by addition of the fourth color (white) as a variable is stored in the control unit 20. That is, the output signal generation circuit 26 stores the maximum value Vmax (S) of the brightness for each of coordinates (values) of the saturation and the hue, about the three-dimensional shape of the enlarged color space illustrated in FIG. 14. The input signal data D2 is configured from the input signal values of the first sub-pixel 49R, the second sub-pixel 49G, and the third sub-pixel 49B, and thus the color space of the input signal data D2 has a columnar shape, that is, the same shape as the columnar shape portion of the enlarged color space. In the first embodiment, the enlarged color space is the HSV color space. However, the enlarged color space is not limited thereto, and may be an XYZ color space, a YUV space, or another coordinate system.

First, based on the input signal values (the input signal value $x_{1-(p,\ q)}$, the input signal value $x_{2-(p,\ q)}$ and the input signal value $x_{3-(p,\ q)}$) of the pixels 48 in the area 42 for which execution of the first processing has been determined (hereinafter, the area 42 is the area 42L), the output signal generation circuit 26 obtains the saturation S and the brightness V (S) in the pixels 48 in the area 42L, and calculates respective expansion coefficients α about the pixels 48 in the area 42. The expansion coefficient α is set for each pixel 48 in the area 42L.

The output signal generation circuit 26 obtains the saturation S and the brightness V(S) for the pixels 48 in the area 42L. Typically, in the (p, q)-th pixel, the saturation $S_{(p,\ q)}$ and the brightness (value) $V(S)_{(p,\ q)}$ of an input color in the columnar HSV color space can be obtained by the following formulas (1) and (2), based on the input signal value $x_{1-(p,\ q)}$ of the first sub-pixel, the input signal value $x_{2-(p,\ q)}$ of the second sub-pixel, and the input signal value $x_{3-(p,\ q)}$ of the third sub-pixel.

$$S_{(p,q)}=(\mathrm{Max}_{(p,q)}-\mathrm{Min}_{(p,q)})/\mathrm{Max}_{(p,q)} \tag{1}$$

$$V(S)_{(p,q)}=\mathrm{Max}_{(p,q)} \tag{2}$$

Here, $\mathrm{Max}_{(p,\ q)}$ is the maximum value of the input signal values of the three sub-pixels 49 ($x_{1-(p,\ q)}$, $x_{2-(p,\ q)}$ and $x_{3-(p,\ q)}$), and $\mathrm{Min}_{(p,\ q)}$ is the minimum value of the input signal values of the three sub-pixels 49 ($x_{1-(p,\ q)}$, $x_{2-(p,\ q)}$, and $x_{3-(p,\ q)}$).

Figure 16:
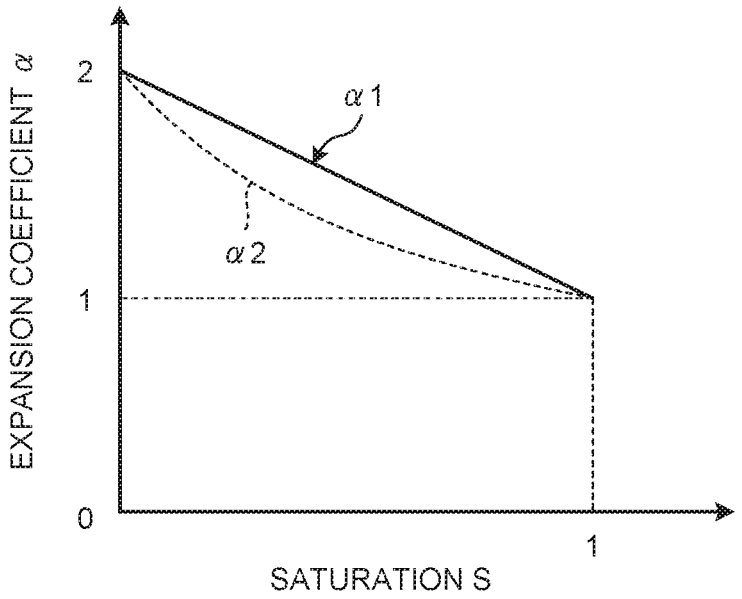
FIG. 16 is a graph illustrating a relationship between saturation and an expansion coefficient in first processing.

The output signal generation circuit 26 calculates the respective expansion coefficients α about the pixels 48 in the area 42L. The expansion coefficient α is set for each pixel 48. The output signal generation circuit 26 calculates the expansion coefficient α such that the value is changed according to the saturation S of the input color. To be specific, the output signal generation circuit 26 calculates the expansion coefficient α such that the value becomes smaller as the saturation S of the input color becomes larger. FIG. 16 is a graph illustrating a relationship between the saturation and the expansion coefficient in the first processing. The horizontal axis of FIG. 16 represents the saturation S of the input color and the vertical axis represents the expansion coefficient α in the first processing. As illustrated by a line segment al in FIG. 16, the output signal generation circuit 26 sets the expansion coefficient α to 2 when the saturation S is zero, makes the expansion coefficient α smaller as the saturation S becomes larger, and sets the expansion coefficient α to 1 when the saturation S is 1. As illustrated by a line segment al in FIG. 16, the expansion coefficient α becomes linearly smaller as the saturation becomes larger. Note that the output signal generation circuit 26 is not limited to calculating the expansion coefficient α according to the line segment α1, and may just calculate the expansion coefficient α such that the value becomes smaller as the saturation S of the input color becomes larger. For example, as illustrated by a line segment α2 of FIG. 16, the output signal generation circuit 26 may make the expansion coefficient α smaller in a quadratic curve manner as the saturation becomes larger. Further, the expansion coefficient α of when the saturation S is zero is not limited to 2, and can be arbitrarily set based on the luminance of the fourth sub-pixel 49W, or the like. Further, the output signal generation circuit 26 may make the expansion coefficient α constant regardless of the saturation of the input color.

Next, the output signal generation circuit 26 calculates an output signal value $X_{4-(p,\ q)}$ of the fourth sub-pixel based on at least the input signal (signal value $x_{1-(p,\ q)}$) of the first sub-pixel, the input signal (signal value $x_{2-(p,\ q)}$) of the second sub-pixel, and the input signal (signal value $x_{3-(p,\ q)}$) of the third sub-pixel. To be specific, the output signal generation circuit 26 calculates the output signal value $X_{4-(p,\ q)}$ of the fourth sub-pixel based on a product of $\mathrm{Min}_{(p,\ q)}$ and the expansion coefficient α of the own pixel $\mathbf{48}_{(p,\ q)}$. To be specific, the output signal generation circuit 26 can obtain the signal value $X_{4-(p,\ q)}$ based on the following formula (3). In the formula (3), the product of the $\mathrm{Min}_{(p,\ q)}$ and the expansion coefficient α is divided by χ. However, the calculation is not limited thereto.

$$X_{4-(p,q)}=\mathrm{Min}_{(p,q)}\cdot\alpha/\chi \tag{3}$$

Here, χ is a constant depending on the display device 10. No color filter is arranged in the fourth sub-pixel 49W that displays white. The fourth sub-pixel 49W that displays the fourth color is brighter than the first sub-pixel 49R that displays the first color, the second sub-pixel 49G that displays the second color, and the third sub-pixel 49B that displays the third color, when the pixels are irradiated with the same light source lighting amount. The luminance of an aggregate of the first sub-pixel 49R, the second sub-pixel 49G, and the third sub-pixel 49B included in the pixel 48 or the group of the pixels 48, of when a signal having a value corresponding to the maximum signal value of the output signal of the first sub-pixel 49R is input to the first sub-pixel 49R, a signal having a value corresponding to the maximum signal value of the output signal of the second sub-pixel 49G is input to the second sub-pixel 49G, and a signal having a value corresponding to the maximum signal value of the output signal of the third sub-pixel 49B is input to the third sub-pixel 49B, is $BN_{1-3}$. Further, assume a case where the luminance of the fourth sub-pixel 49W, of when a signal having a value corresponding to the maximum signal value of the output signal of the fourth sub-pixel 49W is input to the fourth sub-pixel 49W included in the pixel 48 or the group of the pixels 48, is $BN_4$. That is, white in the maximum luminance is displayed by the aggregate of the first sub-pixel 49R, the second sub-pixel 49G, and the third sub-pixel 49B, and the luminance of white is expressed by $BN_{1-3}$. Then, the constant χ is expressed by $\chi=BN_4/BN_{1-3}$, where χ is the constant depending on the display device 10.

To be specific, luminance $BN_4$ of when the input signal having the value 255 of the display gradation is assumed to be input to the fourth sub-pixel 49W, to luminance $BN_{1-3}$ of white of when the signal value $x_{1-(p,\ q)}=255$, the signal value $x_{2-(p,\ q)}=255$, and the signal value $x_{3-(p,\ q)}=255$ are input to the aggregate of the first sub-pixel 49R, the second sub-pixel 49G, and the third sub-pixel 49B, as input signals having values of the next display gradation, is 1.5 times. That is, χ=1.5 in the first embodiment.

Next, the output signal generation circuit 26 calculates the output signal (signal value $X_{1-(p,\ q)}$) of the first sub-pixel based on at least the input signal value $x_{1-(p,\ q)}$ of the first sub-pixel and the expansion coefficient α of the own pixel $\mathbf{48}_{(p,\ q)}$. The output signal generation circuit 26 calculates the output signal (signal value $X_{2-(p,\ q)}$) of the second sub-pixel based on at least the input signal value $x_{2-(p,\ q)}$ of the second sub-pixel and the expansion coefficient α of the own pixel $\mathbf{48}_{(p,\ q)}$. The output signal generation circuit 26 calculates the output signal (signal value $X_{3-(p,\ q)}$) of the third sub-pixel based on at least the input signal value $x_{3-(p,\ q)}$ of the third sub-pixel and the expansion coefficient α of the own pixel $\mathbf{48}_{(p,\ q)}$.

To be specific, the output signal generation circuit 26 calculates the output signal of the first sub-pixel based on the input signal and the expansion coefficient $\alpha$ of the first sub-pixel and the output signal of the fourth sub-pixel. The output signal generation circuit 26 calculates the output signal of the second sub-pixel based on the input signal and the expansion coefficient $\alpha$ of the second sub-pixel and the output signal of the fourth sub-pixel. The output signal generation circuit 26 calculates the output signal of the third sub-pixel based on the input signal and the expansion coefficient $\alpha$ of the third sub-pixel and the output signal of the fourth sub-pixel.

That is, the output signal generation circuit 26 obtains the output signal value $X_{1-(p,\ q)}$ of the first sub-pixel, the output signal value $X_{2-(p,\ q)}$ of the second sub-pixel, and the output signal value $X_{3-(p,\ q)}$ of the third sub-pixel to the (p, q)-th pixel (or the set of the first sub-pixel 49R, the second sub-pixel 49G, and the third sub-pixel 49B), where x is the constant depending on the display device, from the following formulas (4), (5), and (6).

$$X_{1-(p,q)}=\alpha\cdot x_{1-(p,q)}-\chi\cdot X_{4-(p,q)} \tag{4}$$

$$X_{2-(p,q)}=\alpha\cdot x_{2-(p,q)}-\chi\cdot X_{4-(p,q)} \tag{5}$$

$$X_{3-(p,q)}=\alpha\cdot x_{3-(p,q)}-\chi\cdot X_{4-(p,q)} \tag{6}$$

When performing the first processing, the output signal generation circuit 26 generates the output signals of the sub-pixels 49 as described above. Next, the summary of how to obtain the signal values $X_{1-(p,\ q)}$, $X_{2-(p,\ q)}$, $X_{3-(p,\ q)}$ and $X_{4-(p,\ q)}$ (the first processing) will be described. The following processing is performed to keep ratios of the luminance of the first primary color displayed by (the first sub-pixel 49R+the fourth sub-pixel 49W), the luminance of the second primary color displayed by (the second sub-pixel 49G+the fourth sub-pixel 49W), and the luminance of the third primary color displayed by (the third sub-pixel 49B+the fourth sub-pixel 49W). Furthermore, the processing is performed to hold (maintain) the color tone. Furthermore, the processing is performed to hold (maintain) the gradation-luminance characteristics (the gamma characteristic and the y characteristic). When all of the input signal values are 0 or small in any pixel 48 or the group of the pixels 48, the expansion coefficients $\alpha$ may just be obtained without including such a pixel 48 or a group of the pixels 48.

(First Step)

First, the output signal generation circuit 26 obtains the saturation S and the brightness V(S) in the pixels 48 in the area 42L, based on the input signal value (the input signal value $x_{1-(p,\ q)}$ the input signal value $x_{2-(p,\ q)}$ and the input signal value $x_{3-(p,\ q)}$ of the pixels 48 in the area 42L for which execution of the first processing has been determined, and calculates the expansion coefficient $\alpha$ for each pixel 48 in the area 42L.

(Second Step)

Next, the output signal generation circuit 26 obtains the signal value $X_{4-(p,\ q)}$, in the (p, q)-th pixel 48, based on at least the signal value $x_{1-(p,\ q)}$, the signal value $x_{2-(p,\ q)}$ and the signal value $x_{3-(p,\ q)}$. In the first embodiment, the output signal generation circuit 26 determines the signal value $X_{4-(p,\ q)}$ based on $Min_{(p,\ q)}$ the expansion coefficient $\alpha$ of the own pixel $\mathbf{48}_{(p,\ q)}$ and the constant $\chi$. To be specific, the output signal generation circuit 26 obtains the signal value $X_{4-(p,\ q)}$ based on the above formula (3), as described above. The output signal generation circuit 26 obtains the signal value $X_{4-(p,\ q)}$ in all of the pixels 48 in the area 42L for which execution of the first processing has been determined.

(Third Step)

Following that, the output signal generation circuit 26 obtains the signal value $X_{1-(p,\ q)}$ in the (p, q)-th pixel 48, based on the signal value $x_{1-(p,\ q)}$ the expansion coefficient $\alpha$ of the own pixel $\mathbf{48}_{(p,\ q)}$ and the signal value $X_{4-(p,\ q)}$ and obtains the signal value $X_{2-(p,\ q)}$ in the (p, q)-th pixel 48, based on the signal value $x_{2-(p,\ q)}$ the expansion coefficient $\alpha$ of the own pixel $\mathbf{48}_{(p,\ q)}$ and the signal value $X_{4-(p,\ q)}$ and obtains the signal value $X_{3-(p,\ q)}$ in the (p, q)-th pixel 48, based on the signal value $x_{3-(p,\ q)}$ the expansion coefficient $\alpha$ of the own pixel $\mathbf{48}_{(p,\ q)}$ and the signal value $X_{4-(p,\ q)}$. To be specific, the output signal generation circuit 26 obtains the signal value $X_{1-(p,\ q)}$ the signal value $X_{2-(p,\ q)}$ and the signal value $X_{3-(p,\ q)}$ in the (p, q)-th pixel 48, based on the above formulas (4) to (6).

When performing the first processing, the output signal generation circuit 26 generates the output signals with the above steps, and outputs the generated output signals to the image display panel drive unit 30.

(Generation of Output Signals by Second Processing)

Next, generation of the output signals by the second processing will be described. The second processing in the present embodiment is processing (W conversion processing) of converting the input signal values to the first sub-pixel 49R, the second sub-pixel 49G, and the third sub-pixel 49B into the output signal values to the first sub-pixel 49R, the second sub-pixel 49G, the third sub-pixel 49B, and the fourth sub-pixel 49W. The second processing is not making the luminance of the displayed image large.

To be specific, in the second processing, the output signal generation circuit 26 obtains the output signal value $X_{4-(p,\ q)}$ of the fourth sub-pixel based on the formula (3), similarly to the first processing. Then, in the second processing, the output signal generation circuit 26 obtains the output signal value $X_{1-(p,\ q)}$ of the first sub-pixel, the output signal value $X_{2-(p,\ q)}$ of the second sub-pixel, and the output signal value $X_{3-(p,\ q)}$ of the third sub-pixel based on the formulas (4) to (6), similarly to the first processing. Note that, in the second processing, the luminance of the displayed image is not made large, and thus the values of the expansion coefficients $\alpha$ are 1.

As described above, the output signal generation circuit 26 executes the first processing or the second processing based on the processing content determined by the processing content determination circuit 25, and generates the output signals. In the first embodiment, the first processing is the luminance expansion processing, as described above, and the second processing is the W conversion processing where the luminance is not expanded, as described above. However, the processing content of the first processing and the second processing is not limited thereto. For example, the processing content may be a primary coloring processing of generating an output signal having a signal value where the color strength is close to that of the primary color, compared with the input signal value. The processing content may be luminance lowering processing of generating an output signal with a lowered signal value, compared with the input signal value. The processing content may be contrast improving processing of generating an output signal with raised contrast from the input signal value. The processing content is not limited to the above examples, and may just be processing of converting the value of the input signal value by predetermined calculation to calculate the output signal value. The processing content includes the two pieces of processing including the first processing and the second processing. However, three or more pieces of processing content may be employed as long as a plurality of pieces of processing content is included. Note that the display device 10 may not include the fourth sub-pixel 49W when not including the processing content of lighting the fourth sub-pixel 49W.

As described above, in the correction mode, the display device 10 can change the processing content for each area 42. In the present embodiment, the area 42 is an area obtained by segmenting the image display area 41 into a plurality of areas. However, the processing may be performed commonly to the entire image display area 41 where the area 42 is set to the entire image display area 41, that is, without segmenting the image display area 41 into the areas.

(Generation of Output Signals in Normal Mode)

Next, processing of generating the output signals in the normal mode will be described. In the normal mode, the output signal generation circuit 26 executes the same processing determined in advance for all of the pixels 48 in one frame. In the present embodiment, the output signal generation circuit 26 executes the second processing for all of the pixels 48 in the one frame. In the normal mode, the normal input signal D3 without including the display control code F is input. Therefore, the control unit 20 executes predetermined processing determined in advance (here, the second processing) for all of the pixels 48, without changing the processing content for each area based on the display control code F. In the present embodiment, the predetermined processing content determined in advance in the normal mode is the second processing, and the second processing is stored in the register in the output signal generation circuit 26, as described above. The output signal generation circuit 26 reads the stored content and performs the predetermined processing. Therefore, even when performing the second processing in the correction mode, the output signal generation circuit 26 similarly reads the stored processing content of the second processing from the register, and performs the processing. Note that the processing in the normal mode may not be the second processing, and may be arbitrary processing content.

Figure 17:
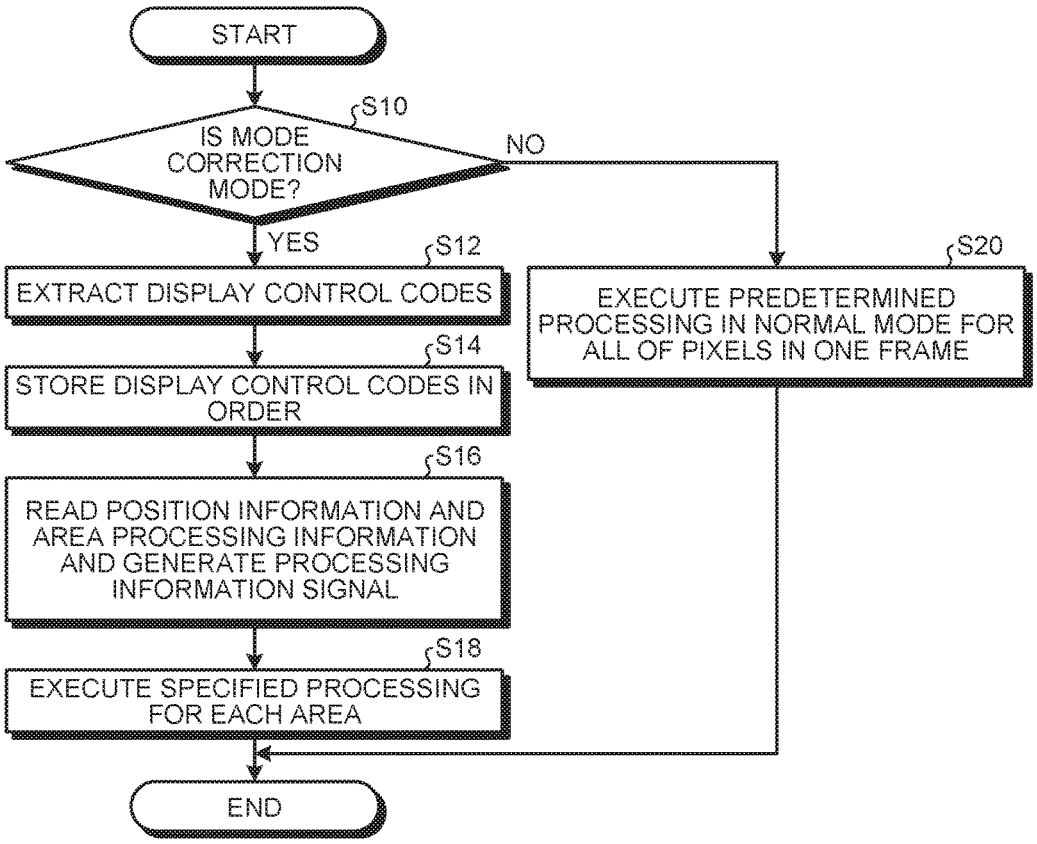
FIG. 17 is a flowchart for describing processing of a control unit in the first embodiment.

Hereinafter, the processing of the control unit 20 will be described based on the flowchart. FIG. 17 is a flowchart for describing the processing of the control unit in the first embodiment.

As illustrated in FIG. 17, the control unit 20 writes the mode information (information as to whether the mode is the normal mode or the correction mode) from the mode information input unit 103 to the register of the control unit 20 with the instruction command, and determines whether the mode is the correction mode (step S10). When the mode is the correction mode (Yes in step S10), the control unit 20 extracts the display control codes F from the correction input signal D4 by the input signal acquisition circuit 22 (step S12), and stores the extracted display control codes F in order by the processing content storage register 24 (step S14).

The control unit 20 then reads the position information and the area processing information that are information included in the plurality of display control codes F stored by the processing content storage register 24, by the processing content determination circuit 25, and generates the processing information signal (step S16). The processing information signal is a signal including the information of the processing content (the first processing or the second processing in the present embodiment), and the position information of the pixels 48 in the area 42 where the processing is to be performed.

After generating the processing information signal, the control unit 20 executes the processing (the first processing or the second processing in the present embodiment) specified for each area 42, to each of the pixels 48, based on the processing information signal, by the output signal generation circuit 26 (step S18), and generates the output signals. When the mode is not the correction mode (No in step S10), that is, when the mode is the normal mode, the control unit 20 executes the predetermined processing (here, the second processing) in the normal mode for all of the pixels 48 in one frame, by the output signal generation circuit 26 (step S20), and generates the output signals. When the output signals are generated in step S18 or S20, the present processing by the control unit 20 is terminated.

(Example of Image in Correction Mode)

Figure 18:
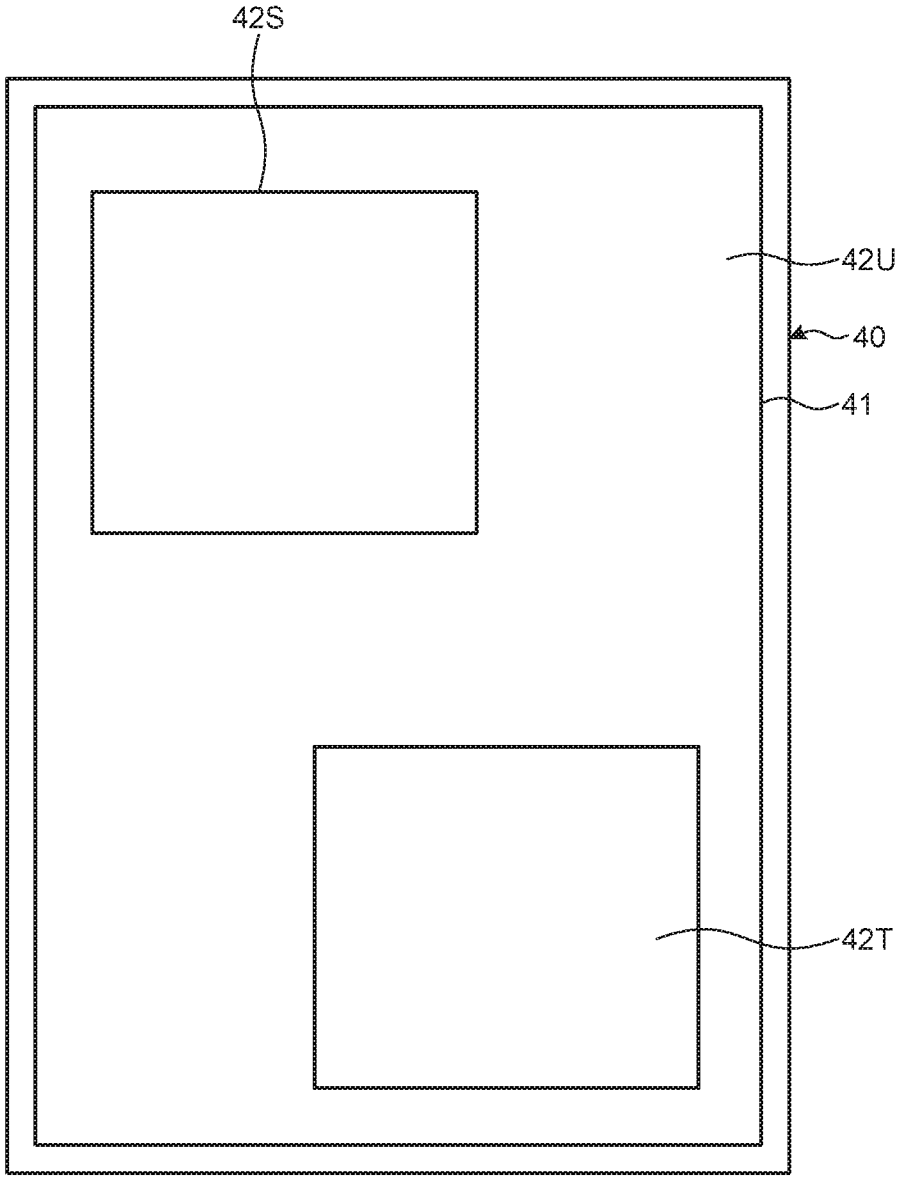
FIG. 18 is an explanatory diagram for describing an example of an image of a case of performing processing in a correction mode.

Hereinafter, an example of an image of when the processing content is changed for each area 42 in the display device 10 in the correction mode will be described. FIG. 18 is an explanatory diagram for describing an example of an image of when the processing in the correction mode is performed. FIG. 18 illustrates an image of when the processing in the correction mode is performed for areas 42S, 42T, and 42U that are partial areas in the image display area 41 of the image display panel 40. An image by a certain application is displayed in the area 42S, an image by an application different from that in the area 42S is displayed in the area 42T, and a background image is displayed in the area 42U. In this example, the processing determination unit 104 of the input signal output unit 100 determines that the areas 42S, 42T, and 42U display mutually different images, based on the image data D1, and segments the area 42S, the area 42T, and the area 42U. The processing determination unit 104 then determines that the images corresponding to the area 42S and the area 42T are images displayed by applications, then determines that the first processing is to be performed for the area 42S and the area 42T. The processing determination unit 104 determines that the image corresponding to the area 42U is the background image, then determines that the second processing is to be performed for the area 42U. The input signal generation unit 106 generates the control input signal D5*a* based on the determination of the processing determination unit 104.

In this case, the display device 10 reads the display control codes F in the control input signal D5*a*, thereby to perform the first processing for the pixels 48 in the area 42S, perform the first processing for the pixels 48 in the area 42T, and perform the second processing for the pixels 48 in the area 42U. Accordingly, the images obtained through the first processing are displayed in the areas 42S and 42T, and the image obtained through the second processing is displayed in the area 42U. Typically, the first processing expands the signal while using the enlarged color space, and thus the luminance is increased. Therefore, the display quality can be improved. Further, the first processing lights the fourth sub-pixel 49W having higher luminance of the color itself than the colors of the other sub-pixels 49, and thus can reduce the power consumption. However, when the area 42U that is the background image displays the primary color, for example, and if the luminance is increased by the first processing, the color becomes paler than the primary color to be displayed, and improvement of the display quality by the first processing cannot be appropriately performed. However, the display device 10 according to the first embodiment can select the processing content for each area. Therefore, when the improvement of the display quality cannot be appropriately performed even if the first processing is performed for the area 42U, the display device 10 can execute the second processing for the area 42U, while executing the first processing for the areas 42S and 42T to increase the luminance and improve the display quality. Further, the second processing is performed for the area 42U and thus the area 42U has lower luminance than the areas 42S and 42T. Therefore, the areas 42S and 42T that are the images used in the applications become brighter than the area 42U that is the background image. Therefore, by the processing, the images used in the applications are dynamically displayed, and the display quality as a whole is improved. Further, in the areas 42S and 42T, the power consumption can be appropriately reduced by the first processing.

For example, a case is considered when the processing content includes processing other than the first processing and the second processing, and the area 42S is an active window operated by an operator and the area 42T is a window not operated by the operator. In this case, the display device 10 executes the first processing for the area 42S, and can execute the luminance lowering processing of lowering the luminance and the second processing for the areas 42T and 42U. Accordingly, the image in the active window is made brighter and other parts are made relatively darker, whereby the image being operated becomes vivid, and the operator can easily recognize the operation screen.

As described above, the processing determination unit 104 of the input signal output unit 100 analyzes the image data D1, and selects the processing content to be executed for each of the respective areas 42. When determining that the image displayed in the area 42 is inappropriate for the first processing from the input signal data D2 in the image data D1, for example, the processing determination unit 104 may determine that the second processing is to be performed for the pixels 48 of the area 42. The image being inappropriate for the first processing means that the improvement of the display quality cannot be expected for the image even if the first processing is performed, and in that case, the second processing is selected. An example of an area where the display quality is deteriorated if the first processing is performed includes the area 42U where the primary color is displayed, as described above.

Hereinafter, a display device 10X according to a comparative example, which does not have a function to read a display control code F and determine processing content, will be described. In an electronic apparatus 1X according to the comparative example, the display device 10X is mounted. When an image is displayed in the display device 10X, an operating system (OS) for operating the electronic apparatus 1X sends a command for displaying the image (image display command) and a command for instructing processing content (processing content command) to the display device 10X, based on a command from an input signal output unit 100X that is an application for displaying the image. The input signal output unit 100X can determine which processing content is to be executed for the image, based on data of the image. Meanwhile, timing to send the image display command and the processing content command to the display device 10X depends on the OS and the display device 10X, rather than the input signal output unit 100X. Therefore, in the comparative example, the electronic apparatus 1*x* cannot synchronize the timing to send the image display command and the processing content command to the display device 10X while determining which processing is to be performed for which image. Therefore, the display device 10X according to the comparative example cannot perform appropriate processing for a plurality of images, and cannot appropriately reduce the power consumption and improve the display quality.

On the other hand, the display device 10 according to the first embodiment includes the image display panel 40, and the control unit 20 that outputs the output signals to the image display panel 40 and causes the image to be displayed. The control unit 20 includes the input signal acquisition circuit 22, the processing content determination circuit 25, and the output signal generation circuit 26. The input signal acquisition circuit 22 acquires the correction input signal D4. The correction input signal D4 includes the control input signal in which a part of data is the input signal data and another part of data is the display control code F. The processing content determination circuit 25 determines the processing content for generating the output signal value based on the display control code F. The output signal generation circuit 26 generates the output signal based on the processing content determined by the processing content determination circuit 25 and the input signal data.

The display device 10 reads the display control code F by the control unit 20, and determines the processing content. Therefore, the display device 10 can determine the processing content by itself, and thus can synchronize the timing to send the image display command and the processing content command while determining which processing is to be performed for which image. Therefore, the display device 10 can appropriately improve the display quality.

In the display device 10, the input signal acquisition circuit 22 acquires the normal input signal D3. The normal input signal D3 includes the input signal data and does not include the display control code F in the normal mode. The input signal acquisition circuit 22 acquires the correction input signal D4 in the correction mode. In the normal mode, the output signal generation circuit 26 generates the output signal based on the normal input signal D3. In the correction mode, the processing content determination circuit 25 determines the processing content based on the display control code F, and the output signal generation circuit 26 generates the output signal based on the processing content determined by the processing content determination circuit 25 and the input signal data. In this way, the display device 10 can switch the mode between the normal mode and the correction mode, thereby to appropriately improve the display quality. Further, the display device 10 can switch the mode between the normal mode and the correction mode, the display device 10 can appropriately perform the processing in the normal mode even when the input signal is the normal input signal D3 that does not include the display control code F, in addition to the processing in the correction mode. That is, the display device 10 can appropriately perform the processing in the normal mode even if the input signal output unit 100 does not have the function to determine whether the mode is the correction mode or the normal mode, and simply has a function to output the normal input signal D3 based on the image data D1.

Further, in the display device 10, the processing content determination circuit 25 selects the processing content from the plurality of pieces of processing content set in advance, based on the display control code F. For example, in the present embodiment, the processing content determination circuit 25 selects any processing content from the first processing and the second processing. The display device 10 selects the processing content from the plurality of pieces of processing content set in advance, thereby to select appropriate processing content for each image. Therefore, the display device 10 can more appropriately reduce the power consumption and improve the display quality.

In the display device 10, the correction input signal D4 to a part of the pixels 48 in the image display panel 40 is the control input signal D5*a*. The correction input signal D4 to another part of the pixels 48 is the pixel input signal D3*a* made of only the input signal data D2 to the another part of the pixels 48. To be specific, in the display device 10, the correction input signal D4 to the pixels 48 in the pixel group 47 is the control input signal D5*a*, and the correction input signal D4 to the pixels 48 other than the pixel group 47 is the pixel input signal D3*a*. In the display device 10, the data of a part of the input signal data D2 is replaced with the display control code F, about only a part of the pixels 48. That is, the display device 10 allows only a part of the pixels 48 to have a decrease in the number of data of the input signal data D2. Therefore, the display device 10 can favorably suppress a decrease in the display quality due to the decrease in the number of data.

The processing content determination circuit 25 extracts the position information of the areas 42 and the area processing information that specifies the processing content for each area 42, based on the plurality of display control codes F. The areas 42 are the area into which the image display area 41 of the image display panel 40 is segmented. The processing content determination circuit 25 then determines the processing content for each area 42, based on the position information and the area processing information. The processing content determination circuit 25 can determine the processing content for each area 42. Therefore, even when displaying a plurality of images, the display device 10 can perform appropriate processing for the images, and thus can appropriately reduce the power consumption and improve the display quality.

The control input signal D5*a* is a signal obtained by converting the input signal data D2 that is a part of the normal input signal D3 made of only the input signal data D2 to all of the pixels 48 in the image display panel 40 into the display control codes F. The control input signal D5*a* is a signal obtained by converting the input signal data D2 that is a part of the normal input signal D3 into the display control codes F. Therefore, the display device 10 can appropriately read the display control codes F.

Further, each of the input signal data D2 of the pixels 48 includes the first input signal data, the second input signal data, and the third input signal data. The control input signal D5*a* is a signal obtained by converting a part of the number of bits of data of at least any of the first input signal data, the second input signal data, and the third input signal data into the display control code F. Since the control input signal D5*a* is a signal obtained by converting the input signal data D2 that is a part of the normal input signal D3 into the display control code F, and thus the display device 10 can reliably read the display control code F.

The control input signal D5*a* is a signal obtained by converting at least any of the lowest bit data of the first input signal data, the lowest bit data of the second input signal data, and the lowest bit data of the third input signal data into the display control code F. The lowest bit data is data in the minimum digit, of a plurality of numbers of bits of data. Since the control input signal D5*a* is obtained by converting the lowest bit data, an increase in the decrease amount of the input signal data D2 can be suppressed. Therefore, the display device 10 can more favorably suppress a decrease in the display quality due to a decrease in the number of data.

The control input signal D5*a* is a signal obtained by converting the lowest bit data of the third input signal data into the display control code F. Since the display device 10 converts the lowest bit data of the third input signal data, the display device 10 can more favorably suppress the decrease in the display quality due to the decrease in the number of data. The third color that is a color displayed with the third input signal data is blue. Blue has small luminance, and thus deterioration of the display quality is less likely to be recognized even if the number of data is decreased. Therefore, the display device 10 can more favorably suppress the decrease in the display quality due to the decrease in the number of data.

Second Embodiment

Next, a second embodiment will be described. A display device 10A according to the second embodiment is different from the first embodiment in that input signals to all of pixels 48 in one frame include a display control code F. Description of portions in the second embodiment, which have a configuration common to the first embodiment, is omitted.

Figure 19:
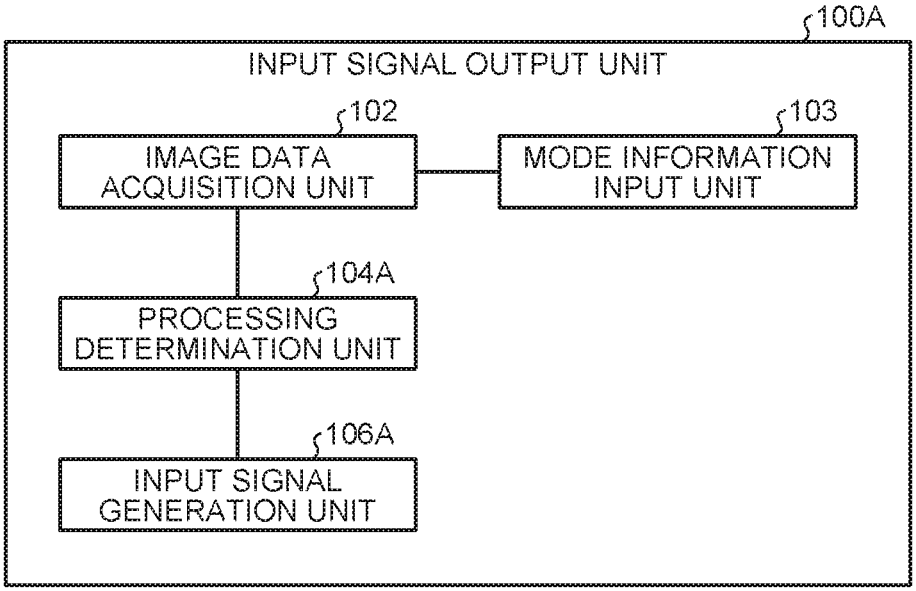
FIG. 19 is a block diagram for schematically describing a configuration of an input signal output unit according to a second embodiment.

FIG. 19 is a block diagram schematically illustrating a configuration of an input signal output unit according to the second embodiment. As illustrated in FIG. 19, an input signal output unit 100A according to the second embodiment includes a processing determination unit 104A and an input signal generation unit 106A.

The processing determination unit 104A analyzes image data D1 (input signal data D2), determines processing content to be performed for an image to be displayed by a method similar to the first embodiment, and generates a display control code FA for each of all of pixels 48 in an image display panel 40. The display control code FA is 1-bit data, and has pixel processing information that specifies processing content of a corresponding pixel 48. In the processing determination unit 104 according to the first embodiment, the plurality of display control codes F (display control data E) configures the position information of an area and the area processing information. However, in the second embodiment, one display control code FA includes pixel processing information of one pixel 48. In the present embodiment, the display control code FA is set to 0 when normal processing is performed for the pixels 48, and the display control code FA is set to 1 when first processing is performed.

The input signal generation unit 106A converts a pixel input signal D3*a* of all of the pixels 48 in the image display panel 40 into a control input signal D5*a*. That is, all of data of a correction input signal D4A in the second embodiment is the control input signal D5*a*, unlike the first embodiment. The control input signal D5*a* is a signal obtained by converting at least a part of data of first input signal data, second input signal data, and third input signal data into a display control code FA, similarly to the first embodiment. More specifically, the control input signal D5*a* is a signal obtained by converting bit data B8 that is the lowest bit data of the third input signal data in the input signal data D2 into the display control code FA.

Figure 20:
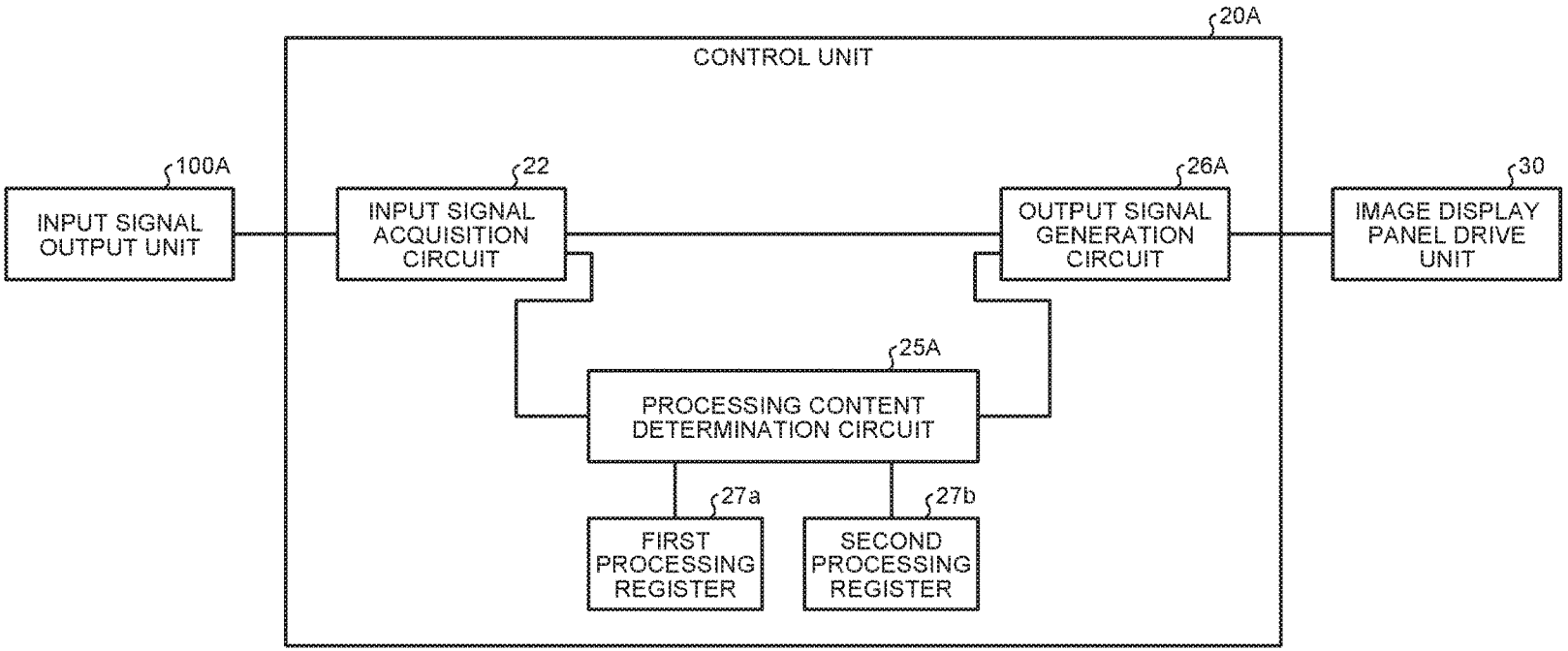
FIG. 20 is a block diagram schematically illustrating a configuration of a control unit according to the second embodiment.

FIG. 20 is a block diagram schematically illustrating a configuration of a control unit according to the second embodiment. As illustrated in FIG. 20, a control unit 20A according to the second embodiment includes a processing content determination circuit 25A, an output signal generation circuit 26A, a first processing register 27*a*, and a second processing register 27*b*. The control unit 20A does not include an input signal data memory 23 and a processing content storage register 24, unlike the first embodiment.

The processing content determination circuit 25A acquires the display control code FA from an input signal acquisition circuit 22, and determines processing content for each of the pixels 48, in a correction mode. The processing content of the first processing is stored in the first processing register 27*a*, and the processing content of second processing is stored in the second processing register 27*b*. The processing content determination circuit 25A reads the pixel processing information in the display control code FA of each of the pixels 48, and determines the processing content for each of the pixels 48. The processing content determination circuit 25A reads the processing content from the register (the first processing register 27*a* or the second processing register 27*b*) in which the determined processing content is stored, and outputs the processing content to the output signal generation circuit 26A. For example, the processing content determination circuit 25A reads the processing content from the first processing register 27*a*, for the pixel 48 with the display control code FA being 1. For example, the processing content determination circuit 25A reads the processing content from the second processing register 27*b*, for the pixel 48 with the display control code FA being 0.

The output signal generation circuit 26A acquires the input signal data D2 of each of the pixels 48 from the input signal acquisition circuit 22, and acquires information of the processing content for each of the pixels 48 from the processing content determination circuit 25A. The output signal generation circuit 26A performs processing of the acquired processing content for each of the pixels 48 to generate an output signal. In the normal mode, since the processing content is determined in advance (here, the second processing), the processing content determination circuit 25A reads the processing content from the second processing register 27*b*, and outputs the processing content to the output signal generation circuit 26A. In the normal mode, the output signal generation circuit 26A executes the second processing to generate the output signal.

In the second embodiment, since all of the pixels 48 have the display control code FA that determines the own processing content, the output signal generation circuit 26A can generate the output signal, for which different processing is performed for each of the pixels 48. Further, since the correction input signal D4A of each of the pixels 48 includes the display control code FA, the control unit 20A does not require an input signal data memory 23 for synchronizing data of the processing content and data of the input signal data D2. Therefore, the control unit 20A can suppress an increase in a circuit scale.

The processing content of the display device 10A in the correction mode is the two pieces of processing including the first processing and the second processing. The processing content of the display device 10A is not limited to the first processing and the second processing, and may be arbitrary processing, similarly to the first embodiment. For example, the processing content of the display device 10A may be two pieces of processing including processing that is a combination of the first processing and contrast improving processing, and processing that does not improve contrast while limiting luminance expansion. Since only one display control code FA is allocated to the correction input signal D4A of one pixel 48, the number of pieces of the processing content is two. However, the display device 10A can include three or more pieces of processing content when allocating a plurality of display control codes FA to the correction input signal D4A of one pixel 48. The number of registers that store the processing content becomes the same number as the number of pieces of the processing content.

Figure 21:
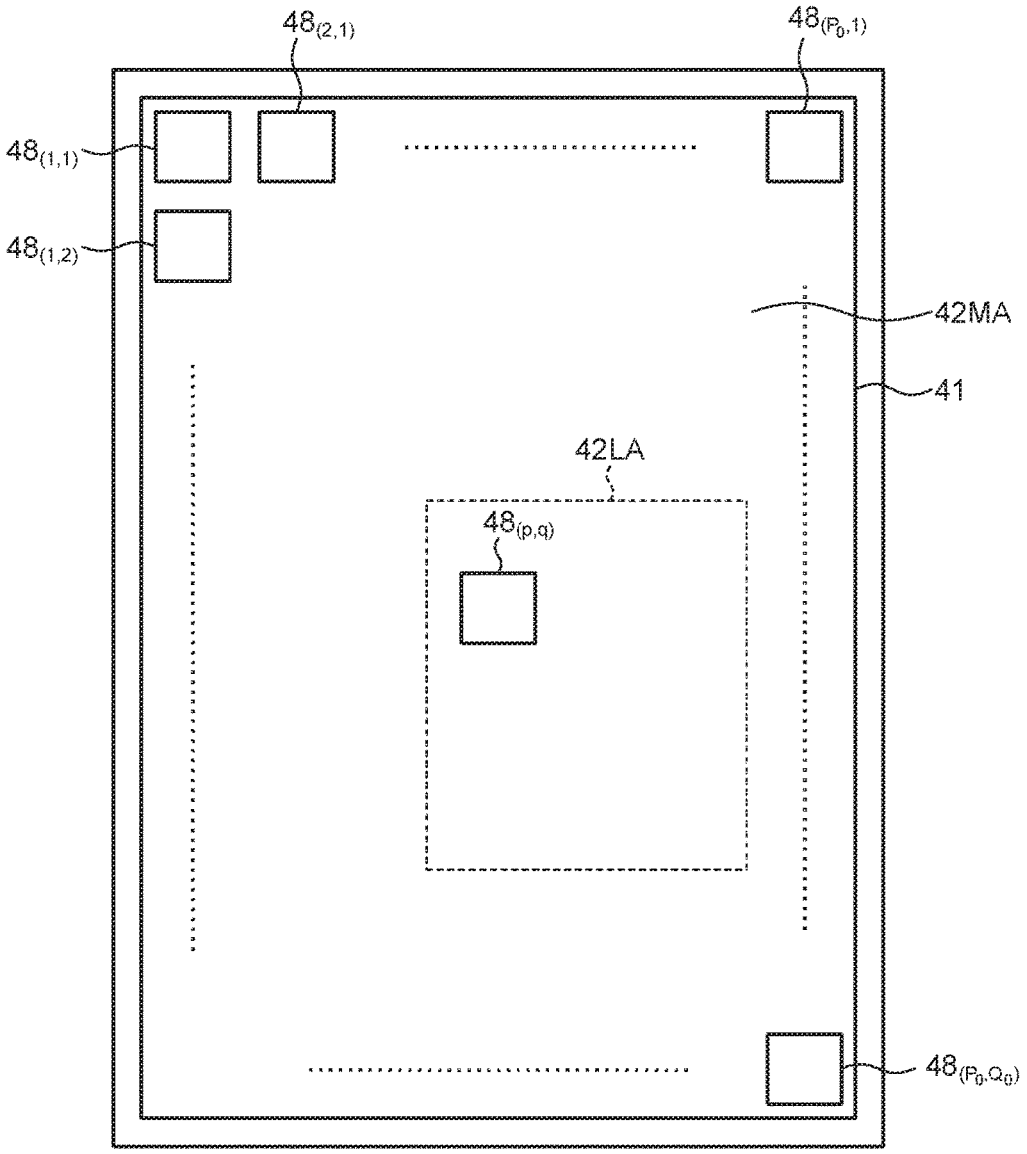
FIG. 21 is an explanatory diagram for describing a method of determining processing in different areas.

Hereinafter, an example of a method of determining the processing in each of the pixels 48 will be described. FIG. 21 is an explanatory diagram for describing a method of determining processing in different areas. In FIG. 21, similarly to FIG. 13 of the first embodiment, the first processing is performed for an area 42LA in the image display panel 40, and the second processing is performed for an area 42MA that is an area other than the area 42LA. The processing content determination circuit 25A reads the display control code FA of each of the pixels 48, and determines the processing content for each of the pixels 48. The value of the display control code FA of each of the pixels 48 in the area 42LA is 1, and the value of the display control code FA in the area 42MA is 0. The processing content determination circuit 25A reads the processing content of the first processing from the first processing register 27*a*, for each of the pixels 48 in the area 42LA, and reads the processing content of the second processing from the second processing register 27*b*, for each of the pixels 48 in the area 42MA. The output signal generation circuit 26A acquires information of the processing content from the processing content determination circuit 25A, executes the first processing for each of the pixels 48 in the area 42LA to generate the output signal, and executes the first processing for each of the pixels 48 in the area 42MA to generate the output signal. As described above, the display device 10A according to the second embodiment can execute different processing for each different area 42, similarly to the first embodiment. Therefore, reduction of power consumption or improvement of display quality can be appropriately performed.

As described above, in the display device 10A according to the second embodiment, the correction input signal D4A to all of the pixels 48 in the image display panel 40 is the control input signal D5*a*. The display control code FA includes the pixel processing information that specifies the processing content of the corresponding pixel 48. The processing content determination circuit 25A according to the second embodiment allocates the processing content to each of the pixels 48 based on the pixel processing information. Therefore, the display device 10A according to the second embodiment can execute different processing for each of the pixels 48, and thus even when displaying a plurality of images, the display device 10A performs appropriate processing for each of the images, thereby to appropriately reduce power consumption and improve display quality.

(Modification)

Next, a modification of the first embodiment will be described. A display device 10B according to the modification is a liquid crystal display device. The display device 10B according to the modification is similar to the first embodiment in other points, and thus description is omitted.

Figure 22:
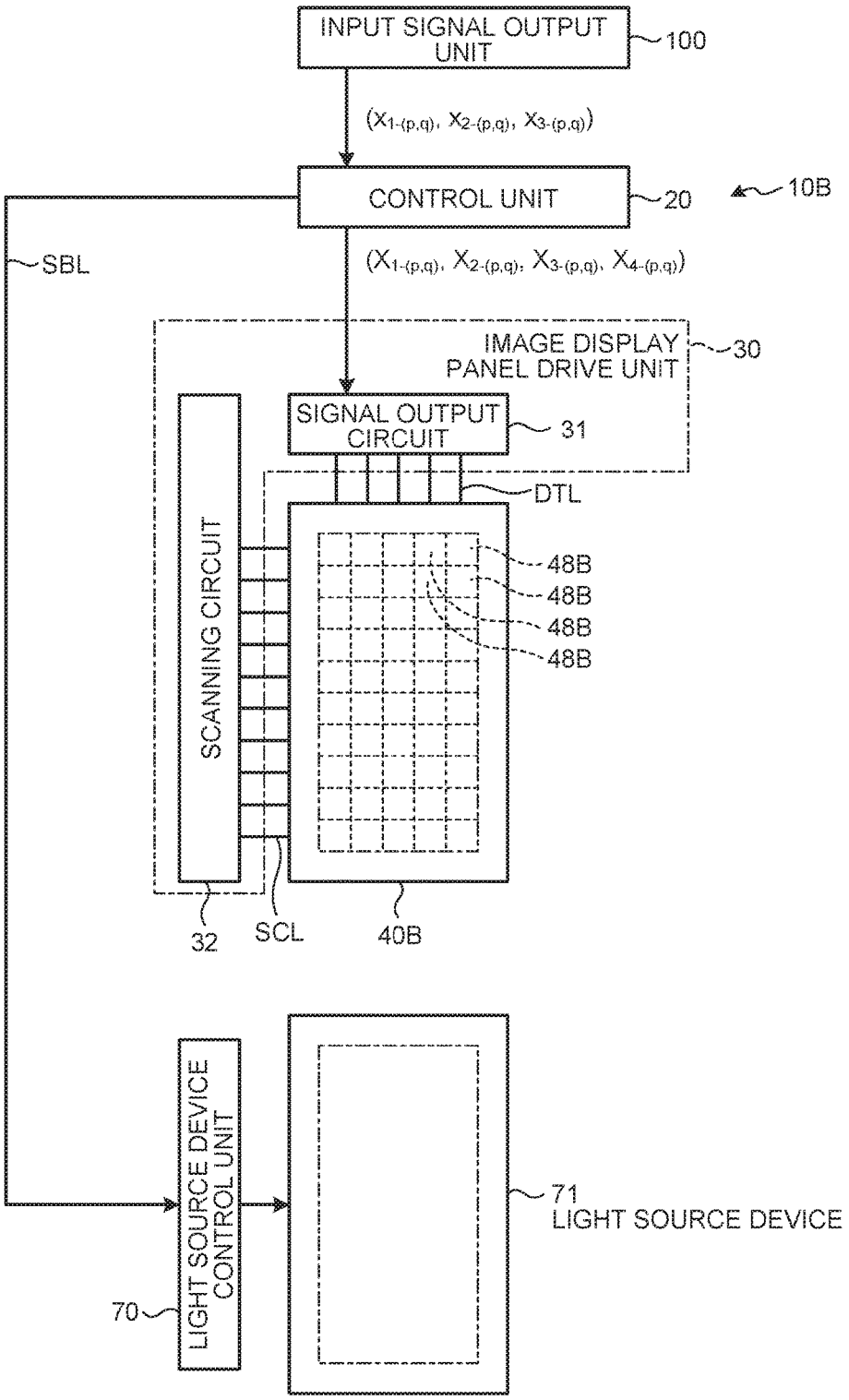
FIG. 22 is a block diagram illustrating an example of a configuration of a display device according to a modification.

FIG. 22 is a block diagram illustrating an example of a configuration of the display device according to the modification. As illustrated in FIG. 22, the display device 10B according to the modification includes an image display panel 40B as a liquid crystal panel, a light source device control unit 70, and a light source device 71. The display device 10B displays an image such that a control unit 20 sends a signal to respective units of the display device 10B, the light source device control unit 70 controls driving of the light source device 71 based on the signal from the control unit 20, and the light source device 71 illuminates the image display panel 40B from the back based on the signal from the light source device control unit 70.

Figure 23:
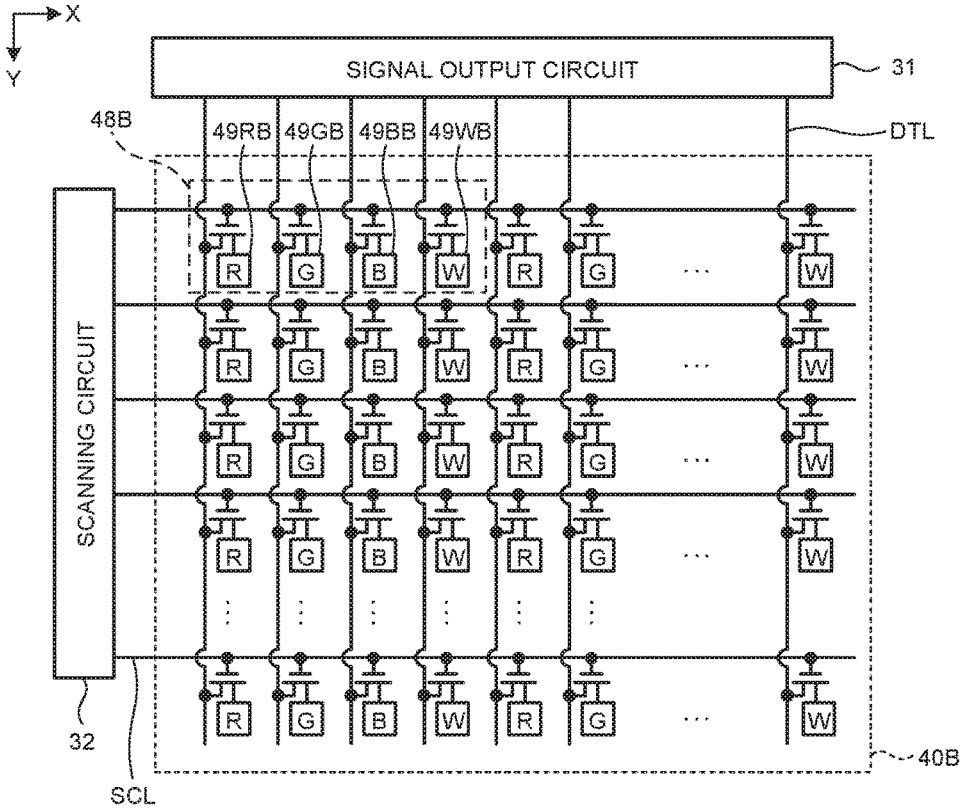
FIG. 23 is a conceptual diagram of an image display panel according to the modification.

FIG. 23 is a conceptual diagram of the image display panel according to the modification. As illustrated in FIG. 23, in the image display panel 40B, pixels 48B including a first sub-pixel 49RB that displays a first color, a second sub-pixel 49GB that displays a second color, a third sub-pixel 49BB that displays a third color, and a fourth sub-pixel 49WB that displays a fourth color are arrayed in a two-dimensional matrix manner.

In the pixels 48B, a liquid crystal layer is provided between two electrodes countering each other. When a voltage by an image output signal is applied to between the two electrodes, the two electrodes generate an electric field in the liquid crystal layer between the electrodes. This electric field twists liquid crystal elements in the liquid crystal layer and changes birefringence. The display device 10B adjusts the quantity of light emitted from the light source device 71 by the birefringence change of the liquid crystal elements, and displays a predetermined image.

The light source device 71 is arranged on the back of the image display panel 40B, and irradiates the image display panel 40B with light by control of the light source device control unit 70, thereby to illuminate the image display panel 40B and display an image. The light source device 71 irradiates the image display panel 40B with light. For example, the light source device 71 may be divided light sources configured from a plurality of light sources, and capable of separately driving the plurality of light sources.

The light source device control unit 70 controls the quantity of light output from the light source device 71, and the like. To be specific, the light source device control unit 70 adjusts a voltage to be supplied to the light source device 71 and the like by pulse width modulation (PWM) or the like, based on a light source device control signal SBL output from the control unit 20, thereby to control the quantity of light (intensity of light) with which the image display panel 40B is irradiated.

In the present modification, the transmissive display device has been used. However, for example, a reflective display device may be used.

Application Example

Figure 24:
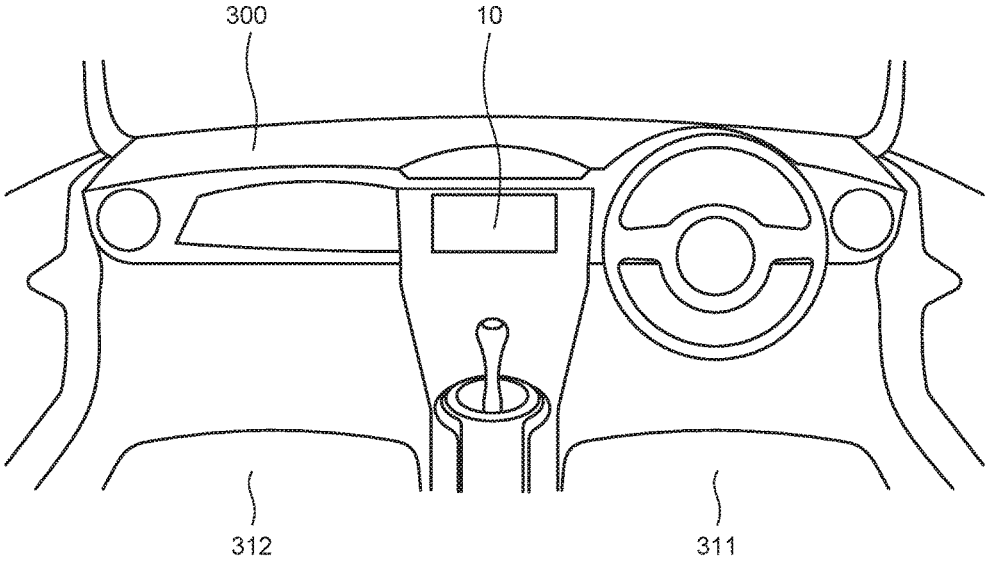
FIG. 24 is a diagram illustrating an example of an electronic apparatus to which the display device according to the first embodiment is applied.
Figure 25:
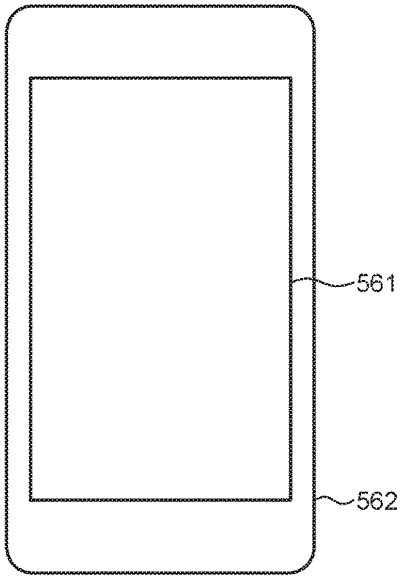
FIG. 25 is a diagram illustrating an example of an electronic apparatus to which the display device according to the first embodiment is applied.

Next, an application example of the display device 10 described in the first embodiment will be described with reference to FIGS. 24 and 25. FIGS. 24 and 25 are diagrams illustrating examples of electronic apparatuses to which the display device according to the first embodiment is applied. The display device 10 according to the first embodiment can be applied to any field of electronic apparatus such as a car navigation system, a television device, a digital camera, or a note-type personal computer illustrated in FIG. 24, or a portable terminal device such as a mobile phone or a video camera illustrated in FIG. 25. In other words, the display device 10 according to the first embodiment can be applied to any field of electronic apparatus that displays a video signal input from an outside or a video signal generated inside the display device as an image or a video. The electronic apparatus 1 includes the input signal output unit 100 (see FIG. 1) that supplies the video signal to the display device, and controls the operation of the display device. The present application example can be applied to the display devices according to the other embodiments and modifications described above, other than the display device 10 according to the first embodiment.

The electronic apparatus illustrated in FIG. 24 is a car navigation device to which the display device 10 according to the first embodiment is applied. The display device 10 is installed in a dashboard 300 inside an automobile. To be specific, the display device 10 is installed between a driver sear 311 and a passenger seat 312 of the dashboard 300. The display device 10 of the car navigation device is used as a navigation display, a display of a music operation screen, a movie playback display, or the like.

The electronic apparatus illustrated in FIG. 25 is an information mobile terminal operated as a mobile computer, a multi-functional mobile phone, a mobile computer that provides voice phone, or a mobile computer that provides communication, to which the display device 10 according to the first embodiment is applied, and may also called smart phone or tablet terminal. This information mobile terminal includes a display unit 561 on a surface of a housing 562, for example. This display unit 561 includes the display device 10 according to the first embodiment and as a touch detection (so-called touch panel) function that can detect an external proximity object.

The embodiments of the present invention have been described. However, these embodiments are not limited by the content of the embodiments. The configuration elements include those easily conceived by a person skilled in the art, those substantially the same, and those so-called within the scope of equivalents. Further, the configuration elements can be appropriately combined. Further, various omissions, replacements, or modifications of the configuration elements can be made without departing from the spirit of the embodiments.

What is claimed is:

1. A display device comprising:

an image display panel in which a plurality of pixels is arranged in a matrix manner; and a control unit configured to output an output signal to the image display panel to display an image, the control unit including an input signal acquisition unit configured to acquire a correction input signal including a control input signal in which a part of data is input signal data including information of an input signal value for causing the pixel to display a predetermined color and another part of data is a display control code, a processing content determination unit configured to determine processing content for processing the input signal data to generate an output signal value of the output signal, based on the display control code, and an output signal generation unit configured to generate the output signal, based on the processing content determined by the processing content determination unit and the input signal data, wherein, the control input signal is a signal obtained by converting a part of the input signal data in a normal input signal into the display control code, the normal input signal including the input signal data and not including the display control code, the input signal data of each of the pixels includes first input signal data that is a plurality of numbers of bits of data including the input signal value for causing the pixel to display a first color, second input signal data that is a plurality of numbers of bits of data including the input signal value for causing the pixel to display a second color, and third input signal data that is a plurality of numbers of bits of data including the input signal value for causing the pixel to display a third color, and the control input signal is a signal obtained by converting a part of the numbers of bits of data of at least any of the first input signal data, the second input signal data, and the third input signal data into the display control code, and the control input signal is a signal obtained by converting at least any of lowest bit data of the first input signal data, lowest bit data of the second input signal data, and lowest bit data of the third input signal data into the display control code.

2. The display device according to claim 1, wherein the input signal acquisition unit acquires the normal input signal in a normal mode, and acquires the correction input signal in a correction mode, in the normal mode, the output signal generation unit generates the output signal, based on the normal input signal, and in the correction mode, the processing determination unit determines the processing content, based on the display control code, and the output signal generation unit generates the output signal, based on the processing content determined by the processing determination unit and the input signal data.

3. The display device according to claim 1, wherein the processing determination unit selects the processing content from among a plurality of pieces of processing content set in advance, based on the display control code.

4. The display device according to claim 1, wherein the correction input signal to a part of the pixels in the image display panel is the control input signal, and the correction input signal to another part of the pixels is a pixel input signal made of only the input signal data for the another part of the pixels.

5. The display device according to claim 4, wherein the processing determination unit extracts position information of areas into which an image display area of the image display panel is divided, and area processing information that specifies the processing content for each of the areas, based on a plurality of the display control codes, and determines the processing content for each of the areas, based on the position information and the area processing information.

6. The display device according to claim 3, wherein the correction input signal to all of the pixels in the image display panel is the control input signal, the display control code includes pixel processing information that specifies the processing content of a corresponding pixel, and the processing determination unit allocates the processing content to each of the pixels, based on the pixel processing information.

7. The display device according to claim 1, wherein the control input signal is a signal obtained by converting the lowest bit data of the third input signal data into the display control code.

8. The display device according to claim 7, wherein the third color is blue.

9. An electronic apparatus comprising:

the display device according to claim 1; and an input signal output unit configured to output the correction input signal to the display device.

10. The electronic apparatus according to claim 9, wherein the input signal output unit converts a normal input signal made of only input signal data including information of an input signal value to all of the pixels of the image display panel into the control input signal.

* * * * *